US011859813B1

(12) United States Patent
Lewis et al.

(10) Patent No.: US 11,859,813 B1
(45) Date of Patent: Jan. 2, 2024

(54) PULVERIZED SOLID FUEL NOZZLE TIP ASSEMBLY WITH LOW CONTACT FRAME

(71) Applicant: GENERAL ELECTRIC TECHNOLOGY GMBH, Baden (CH)

(72) Inventors: John Childs Lewis, Feeding Hills, MA (US); Richard Edward Donais, West Suffield, CT (US); Kevin T. Grzebien, Southwick, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 18/082,901

(22) Filed: Dec. 16, 2022

(51) Int. Cl.
*F23D 1/00* (2006.01)

(52) U.S. Cl.
CPC ..... *F23D 1/00* (2013.01); *F23D 2201/101* (2013.01); *F23D 2201/20* (2013.01)

(58) Field of Classification Search
CPC .. F23D 2201/101; F23D 1/00; F23D 2201/10; F23C 5/06
See application file for complete search history.

(56) References Cited

U.S. PATENT DOCUMENTS 2,895,435 A 7/1959 Bogot et al.
3,823,875 A * 7/1974 Bauer ..... F23D 1/00 239/590.5
4,356,975 A * 11/1982 Chadshay ..... F23D 1/00 239/590.5
5,215,259 A * 6/1993 Wark ..... F23D 1/00 239/587.6
6,145,449 A * 11/2000 Kaneko ..... F23D 1/02 239/590.5
6,439,136 B1 * 8/2002 Mann ..... F23D 1/00 239/DIG. 19
8,267,020 B2 9/2012 Mann
(Continued)

FOREIGN PATENT DOCUMENTS

CN 1 205 766 1/1999
EP 1402215 A1 3/2004
(Continued)

OTHER PUBLICATIONS

Corresponding PCT International Search Report and Written Opinion dated Jul. 25, 2023.

*Primary Examiner* — Jorge A Pereiro
(74) *Attorney, Agent, or Firm* — Grogan, Tuccillo & Vanderleeden, LLP

(57) ABSTRACT

A pulverized solid fuel nozzle tip assembly with a low contact frame for use with a pulverized solid fuel pipe nozzle is described. The pulverized solid fuel nozzle tip assembly has an outer nozzle tip portion adapted to mount in supported relation with the pulverized solid fuel pipe nozzle, and an inner nozzle tip portion adapted for mounting within the outer nozzle tip portion to have secure tiltable movement. The outer nozzle has supporting surfaces that support surfaces of the inner nozzle tip portion to minimize the tilting forces transmitted to the inner nozzle tip portion during normal furnace operation, enhancing the wear resistance of the pulverized solid fuel nozzle tip assembly. The supporting surfaces of the outer nozzle also eliminate stress cracking to the surfaces of the inner nozzle tip portion that can arise due to thermal growth.

15 Claims, 12 Drawing Sheets

(56) References Cited

U.S. PATENT DOCUMENTS

| | | | | |
|---|---|---|---|---|
| 8,561,553 | B2 * | 10/2013 | Morse | F23D 1/00 110/104 B |
| 8,701,572 | B2 * | 4/2014 | Donais | F23D 1/00 110/104 B |
| 10,174,939 | B2 | 1/2019 | Coyle et al. | |
| 2005/0235888 | A1 * | 10/2005 | Mann | F23D 1/00 110/263 |
| 2007/0234938 | A1 * | 10/2007 | Briggs, Jr. | F23D 1/00 110/263 |
| 2008/0304956 | A1 * | 12/2008 | Mann | F23C 5/02 415/115 |
| 2011/0114763 | A1 * | 5/2011 | Briggs, Jr. | F23D 1/00 239/587.6 |
| 2011/0117507 | A1 * | 5/2011 | Briggs, Jr. | F23D 1/00 431/189 |
| 2011/0297762 | A1 * | 12/2011 | Wark | F23D 1/00 239/587.6 |
| 2016/0169507 | A1 * | 6/2016 | Coyle | F23D 1/00 110/263 |
| 2021/0220848 | A1 * | 7/2021 | Dunnu | F23N 1/00 |
| 2023/0038688 | A1 * | 2/2023 | Grzebien | B05B 7/1486 |
| 2023/0061105 | A1 * | 3/2023 | Grusha | F23D 1/00 |

FOREIGN PATENT DOCUMENTS

| | | | |
|---|---|---|---|
| KR | 100688624 | B1 | 3/2007 |
| KR | 102080564 | B1 | 2/2020 |

* cited by examiner

PULVERIZED SOLID FUEL NOZZLE TIP ASSEMBLY WITH LOW CONTACT FRAME

CROSS REFERENCE TO RELATED APPLICATIONS

The present patent application is related by subject matter to concurrently filed, co-pending, and commonly assigned International Application No. PCT/162022/062409, entitled "PULVERIZED SOLID FUEL NOZZLE TIP ASSEMBLY WITH LOW CONTACT FRAME," the disclosure of which is incorporated herein by reference in its entirety.

BACKGROUND

Technical Field

Embodiments of this disclosure relate generally to pulverized solid fuel-fired boilers that generate steam that may be used for power generation with steam driven generators, and more specifically, to an improved pulverized solid fuel nozzle tip assembly with a low contact frame for use with a pulverized solid fuel pipe nozzle to issue a stream of pulverized solid fuel and air to a combustion chamber within a pulverized solid fuel-fired boiler.

Discussion of Art

A steam generator such as a pulverized solid fuel-fired boiler generally includes a plurality of nozzle arrangements through which pulverized coal is delivered into a firing system or combustion chamber of the boiler for combustion in order to produce steam that can be used to power a steam turbine that drives a generator to produce electricity. The nozzle arrangements are typically disposed within windboxes, which may be located proximate to the corners of the boiler. Each nozzle arrangement can include a coal pipe nozzle to provide a stream of pulverized coal and air, and a nozzle tip which protrudes into the boiler to issue the stream of pulverized coal and air to the combustion chamber. The nozzle tip is typically hingedly connected to the main conduit portion of the coal pipe nozzle. To this extent, the nozzle tip can be varied in direction within the combustion chamber for temperature control purposes. For example, the nozzle tip can be tilted up and down to adjust the location of the generated flame or fireball within the combustion chamber to control the flame temperature, and changed clockwise or counterclockwise with respect to the flame in the center of the combustion chamber to alter the direction in which the stream of pulverized coal and air is supplied.

The environment in which the nozzle tip operates is extremely harsh due to the highly abrasive nature of the pulverized coal and the high temperatures of the heat associated with the flame generated in the combustion chamber. For example, the flow of the highly abrasive pulverized coal through the nozzle tip can rapidly wear away portions of the nozzle tip. In addition, the high temperatures of the heat associated with the flame in the combustion chamber and the flow of air provided by the structure of the nozzle tip produce high temperature gradients that can lead to extreme internal stresses.

Other stresses can arise due to thermal growth or expansion of the components of the nozzle tip assembly. For example, in operation of a conventional nozzle tip assembly that includes an outer nozzle tip portion and an inner nozzle tip portion, elements of the outer nozzle tip portion can come into contact with the inner nozzle tip portion at the occurrence of thermal expansion of the components of the nozzle tip assembly. This can lead to the formation of cracks in the inner nozzle tip portion as these elements of the outer nozzle tip portion expand into the inner nozzle tip portion.

As a result, a typical solid fuel nozzle tip assembly used to issue a stream of pulverized coal and air to a pulverized coal-fired boiler has a low wear resistance that leads to failure of the nozzle tip. Moreover, a nozzle tip assembly with a low wear resistance typically has a decreased service life that is generally beset with higher maintenance costs.

BRIEF DESCRIPTION

The following presents a simplified summary of the disclosed subject matter in order to provide a basic understanding of some aspects of the various embodiments described herein. This summary is not an extensive overview of the various embodiments. It is not intended to exclusively identify key features or essential features of the claimed subject matter set forth in the Claims, nor is it intended as an aid in determining the scope of the claimed subject matter. Its sole purpose is to present some concepts of the disclosure in a streamlined form as a prelude to the more detailed description that is presented later.

The aforementioned drawbacks associated with the typical solid fuel nozzle tip assembly used to issue a stream of pulverized coal and air to a pulverized coal-fired boiler create the need for a nozzle tip assembly that can better withstand the harsh environment in which it operates and eliminate stress cracking that can arise in components of the assembly such as the inner nozzle tip portion due to thermal expansion of elements of the outer nozzle tip portion into the inner nozzle tip portion. The various embodiments provide a pulverized solid fuel nozzle tip assembly that overcomes the deficiencies associated with the typical solid fuel nozzle tip assembly. In particular, the pulverized solid fuel nozzle tip assembly of the various embodiments includes an outer nozzle tip portion, also referred to as a "driver", that is adapted to mount in supported relation with a pulverized solid fuel pipe nozzle, and a monolithic, ceramic, inner nozzle tip portion, also referred to as a "body", that is tiltably secured to the outer nozzle tip portion for longitudinal movement relative to the outer nozzle tip portion. To this extent, a flow channel of the inner nozzle tip portion is operative to receive a stream of pulverized solid fuel and air from the pulverized solid fuel pipe nozzle and issue this stream of solid fuel and air into the combustion chamber of the boiler, while the outer nozzle tip portion can also be operative to provide a secondary stream of air into the combustion chamber.

In order to address the stress cracking concerns that can arise due to thermal growth or expansion of the components of the nozzle tip assembly, the outer nozzle tip portion of the various embodiments, which can be stainless steel, includes a frame that eliminates stress cracking to the inner nozzle tip portion, which can be a ceramic material. In particular, the frame can include a pair of opposing lateral sidewalls with bearing surfaces that can facilitate the tilting of the inner nozzle tip portion in relation to the outer nozzle tip portion. The lateral sidewalls of the frame of the outer nozzle tip portion contain no extraneous elements that can expand and come into contact with the inner nozzle tip portion, and thus cause cracking of the inner nozzle tip portion. With all extraneous elements removed from the lateral sidewalls of the frame of the outer nozzle tip portion, the possibility of the stainless steel outer nozzle tip portion expanding into the ceramic inner nozzle tip portion and cracking this component due to thermal expansion differentials between the ceramic and stainless steel components is eliminated/reduced. Not only does the frame of the outer nozzle tip portion eliminate/reduce cracking of the inner nozzle tip portion due to different material expansion rates, but the design of the frame of the various embodiments also enables the outer nozzle tip portion to still protect the ceramic components of the inner nozzle tip portion and allow it to tilt by providing a large surface area that drives the inner nozzle tip portion throughout its tilting motion. For example, the outer nozzle tip portion can take the majority of the forces from a tilting link arm mechanism used to facilitate the tilting of the inner nozzle tip portion in relation to the outer nozzle tip portion without transferring the majority of those forces to the ceramic components of the inner nozzle tip portion.

In one embodiment, each of the opposing lateral sidewalls of the outer nozzle tip portion include a front surface having a contoured profile defining a plurality of spaced recess portions with nose portions formed therebetween. A plurality of inset lug plates can be coupled to the pair of opposing lateral sidewalls. Each inset lug plate can be disposed flush with one of the nose portions in each of the opposing lateral sidewalls. The outer nozzle tip portion can further include a seal frame structure located interior to the pair of opposing lateral sidewalls. The seal frame structure can have a top plate and a bottom plate spaced apart from the top plate. Both the top plate and the bottom plate can extend horizontally between the pair of opposing lateral sidewalls.

In one embodiment, the inner nozzle tip portion can include a pair of opposing sidewalls. Each of the opposing sidewalls can have a back surface with a contoured profile defining a plurality of spaced recess portions with nose portions formed therebetween. The nose portions on the back surfaces of the opposing sidewalls of the inner nozzle tip portion can be seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion can be seated correspondingly in the recess portions on the back surfaces of the sidewalls of the inner nozzle tip portion.

In one embodiment, a pair of opposing pivot pins can be used to tiltably secure the inner nozzle tip portion to the lateral sidewalls of the outer nozzle tip portion. For example, the pivot pins can extend through one of the nose portions on the back surfaces of the opposing sidewalls of the inner nozzle tip portion and one of the recess portions of the opposing lateral sidewalls of the outer nozzle tip portion.

The pivot pins can be placed in a corresponding pair of opposing pivot pin mounting bores that extend through the lateral sidewalls of the outer nozzle tip portion and the sidewalls of the inner nozzle tip portion. Bushings can be placed in each of the opposing pivot pin mounting bores to rotatably support the pivot pins. In one embodiment, the pivot pins, the pivot pin mounting bores, and the bushings can be positioned in a central location relative to the sidewalls of the inner nozzle tip portion and the outer nozzle tip portion on a lateral centerline to facilitate titling of the inner nozzle tip portion over a predetermined a tilt range.

In one embodiment, an inner nozzle tip protection part can extend from the top plate and the bottom plate of the seal frame structure over the top surface and the bottom surface of the inner nozzle tip portion, respectively. In this manner, the inner nozzle tip protection part can serve to protect the monolithic, ceramic inner nozzle tip portion from items that can include, but are not limited to, slag falling from the furnace walls. In addition, the inner nozzle tip protection part can receive the secondary stream of air from air passages of an air shroud that is integrated with the outer nozzle tip portion.

The pulverized solid fuel nozzle tip assembly of the various embodiments is an improvement over the typical solid fuel nozzle tip assembly used to issue a stream of pulverized solid fuel and air to a pulverized solid fuel-fired boiler. Specifically, the pulverized solid fuel nozzle tip assembly of the various embodiments has a high wear resistance due to the use of a ceramic material with the inner nozzle tip portion. Ceramics, as opposed to stainless steel, are better suited to withstand the high temperatures of the heat associated with the flame in the combustion chamber, in which the inner nozzle tip portion is disposed. In addition, the use of ceramics with the inner nozzle tip portion is better suited to endure the highly abrasive pulverized coal because of its high wear resistance. This ensures that the pulverized solid fuel nozzle tip assembly of the various embodiments can work for a longer period of time without the need for more frequent servicing. Accordingly, the pulverized solid fuel nozzle tip assembly of the various embodiments is expected to have an increased service life with reduced maintenance costs in comparison to the typical solid fuel nozzle tip assembly that has a low wear resistance, a shorter overall service life cycle, and more maintenance costs due to the servicing that is needed because of its low wear resistance from operating in an extremely harsh environment.

Another improvement associated with the pulverized solid fuel nozzle tip assembly of the various embodiments is that it provides an enhanced tilt range due to the use and positioning of the pivot pins, the pivot pin mounting bores, and the bushings that tiltably secure the inner nozzle tip portion to the outer nozzle tip portion.

In addition to providing an enhanced tilt range, the pulverized solid fuel nozzle tip assembly of the various embodiments minimizes the tilting forces that cause damage to the typical pulverized solid fuel nozzle tip assembly. In particular, the supporting structures of the outer nozzle tip portion and the inner nozzle tip portion, and their complementary surfaces, maintain support of the inner nozzle tip portion within the outer nozzle tip portion during normal boiler operation, such that the tilting forces used to tilt the inner nozzle tip portion are applied to the outer nozzle tip portion. This is due to the enlarged contact surface area that the inner nozzle tip portion experiences, which reduces point contact loading. As a result, the tilting forces that are applied to the inner nozzle tip portion will be minimized. Minimizing tilting forces in this manner inhibits point contact loading and stress to the inner nozzle tip portion.

The pulverized solid fuel nozzle tip assembly of the various embodiments also eliminates stress cracking to the inner nozzle tip portion that can arise due to thermal growth of the components of the nozzle tip assembly. In particular, the lateral sidewalls of the frame of the outer nozzle tip portion contain no extraneous elements that can expand and come into contact with the inner nozzle tip portion, and thus cause cracking of the inner nozzle tip portion. With all extraneous elements removed from the lateral sidewalls of the frame of the outer nozzle tip portion, the possibility of the stainless steel outer nozzle tip portion expanding into the ceramic inner nozzle tip portion and cracking the inner nozzle tip portion due to thermal expansion differentials between the ceramic and stainless steel components of the inner nozzle tip portion and the outer nozzle tip portion, respectively, is eliminated/reduced.

The previously mentioned benefit of tolerating high temperatures through the use of ceramics can be further enhanced by the feature of the air shroud associated with the outer nozzle tip portion. That is, a plurality of air passages provided by the air shroud can enable the pulverized solid fuel nozzle tip assembly of the various embodiments to offer further cooling to the inner nozzle tip portion by delivering the secondary air towards the outer surfaces of the inner nozzle tip portion and shade it from furnace radiation. Not only will the plurality of air passages help the pulverized solid fuel nozzle tip assembly of the various embodiments operate in extremely high temperatures, but these air passages in the outer nozzle tip portion can make it possible to manufacture the ceramic portion of the nozzle tip assembly with lower overall manufacturing costs since a monolithic, ceramic inner nozzle tip portion can be fabricated without these air passages.

In accordance with one embodiment, a pulverized solid fuel nozzle tip assembly adapted for cooperative operation with a pulverized solid fuel pipe nozzle to issue a stream of pulverized solid fuel and air to a pulverized solid fuel-fired boiler is provided. The pulverized solid fuel nozzle tip assembly of this embodiment comprises: an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes: a pair of opposing lateral sidewalls, each of the opposing lateral sidewalls including a front surface having a contoured profile defining a plurality of spaced recess portions with nose portions formed therebetween; a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom plate extending horizontally between the pair of opposing lateral sidewalls; and an inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes: a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion.

In accordance with another embodiment, a pulverized coal nozzle tip assembly adapted for cooperative operation with a pulverized coal pipe nozzle to issue a stream of pulverized coal and air to a coal-fired boiler is provided. The pulverized coal nozzle tip assembly of this embodiment comprises: an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes: a pair of opposing lateral sidewalls, each of the opposing lateral sidewalls including a front surface having a contoured profile defining a plurality of spaced recess portions with nose portions formed therebetween; a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom extending horizontally between the pair of opposing lateral sidewalls; a monolithic, ceramic, inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes: a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion; and an air shroud adapted to receive a secondary stream of air, the air shroud having a first plurality of air passages located on the top plate of the seal frame structure, secured between the pair of opposing lateral sidewalls, and a second plurality of air passages located under the bottom plate of the seal frame structure, secured between the pair of opposing lateral sidewalls, both the first plurality of air passages and the second plurality of air passages are adapted to produce different flow pathways for the secondary stream of air.

In accordance with yet another embodiment, a method of servicing a coal-fired boiler having a combustion chamber for combusting a stream of pulverized coal and air carried by an arrangement of pulverized coal pipe nozzles with pulverized coal nozzle tip assemblies to issue the stream into the combustion chamber is provided. The method of this embodiment comprises: retrofitting the arrangement of pulverized coal pipe nozzles with one or more modified pulverized coal nozzle tip assembly. Each modified pulverized coal nozzle tip assembly comprises: an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes: a pair of opposing lateral sidewalls, each of the opposing lateral sidewalls including a front surface having a contoured profile defining a plurality of spaced recess portions with nose portions formed therebetween; a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom extending horizontally between the pair of opposing lateral sidewalls; a monolithic, ceramic, inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes: a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion; and an air shroud adapted to receive a secondary stream of air, the air shroud having a first plurality of air passages located on the top plate of the seal frame structure, secured between the pair of opposing lateral sidewalls, and a second plurality of air passages located under the bottom plate of the seal frame structure, secured between the pair of opposing lateral sidewalls, both the first plurality of air passages and the second plurality of air passages are adapted to produce different flow pathways for the secondary stream of air.

DRAWINGS

The present invention will be better understood from reading the following description of non-limiting embodiments, with reference to the attached drawings, wherein below:

Figure 9:
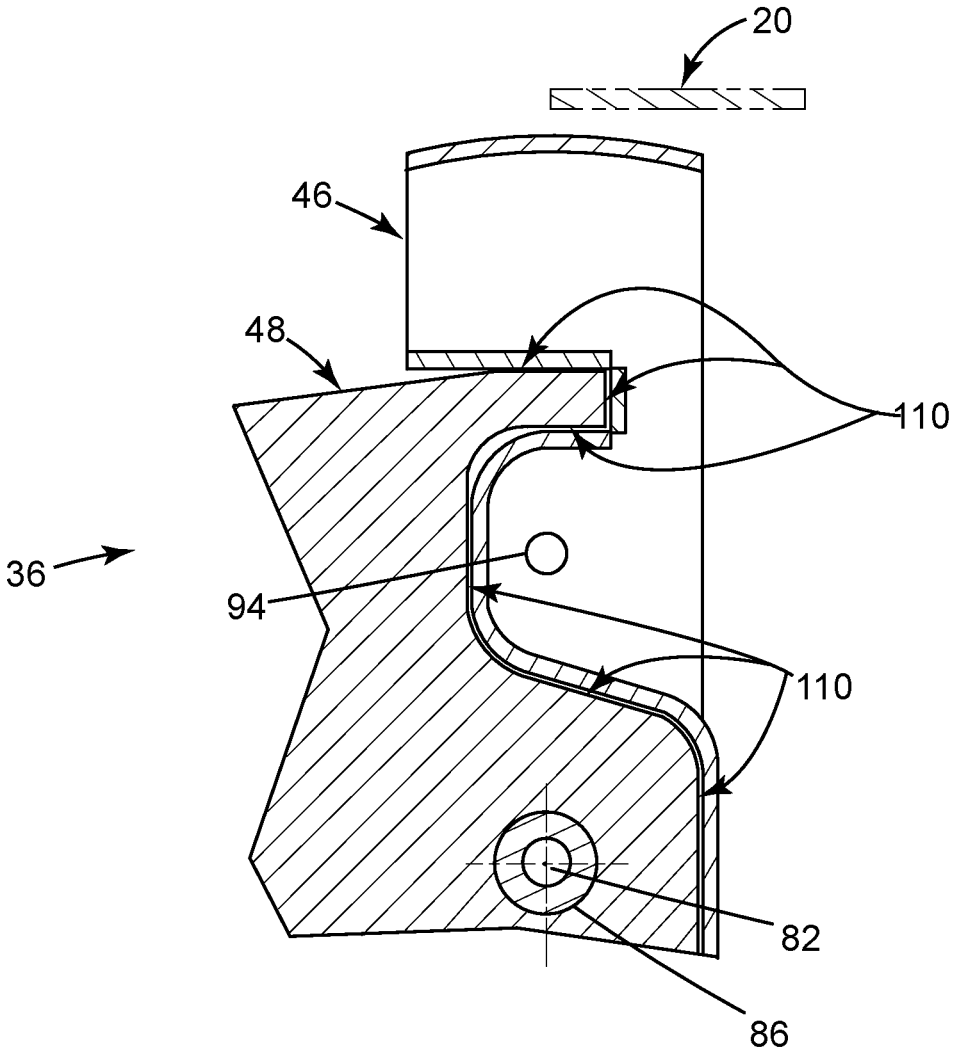
Figure 10:
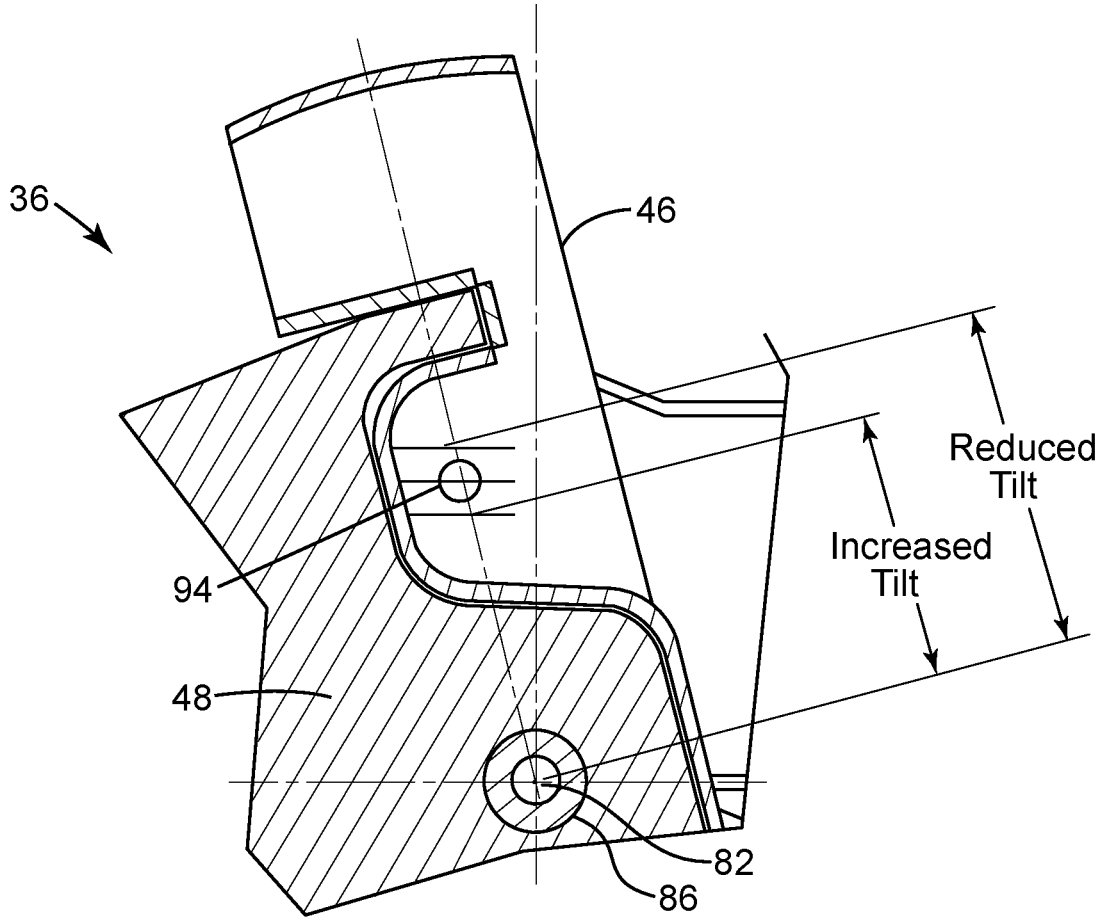
Figure 11:
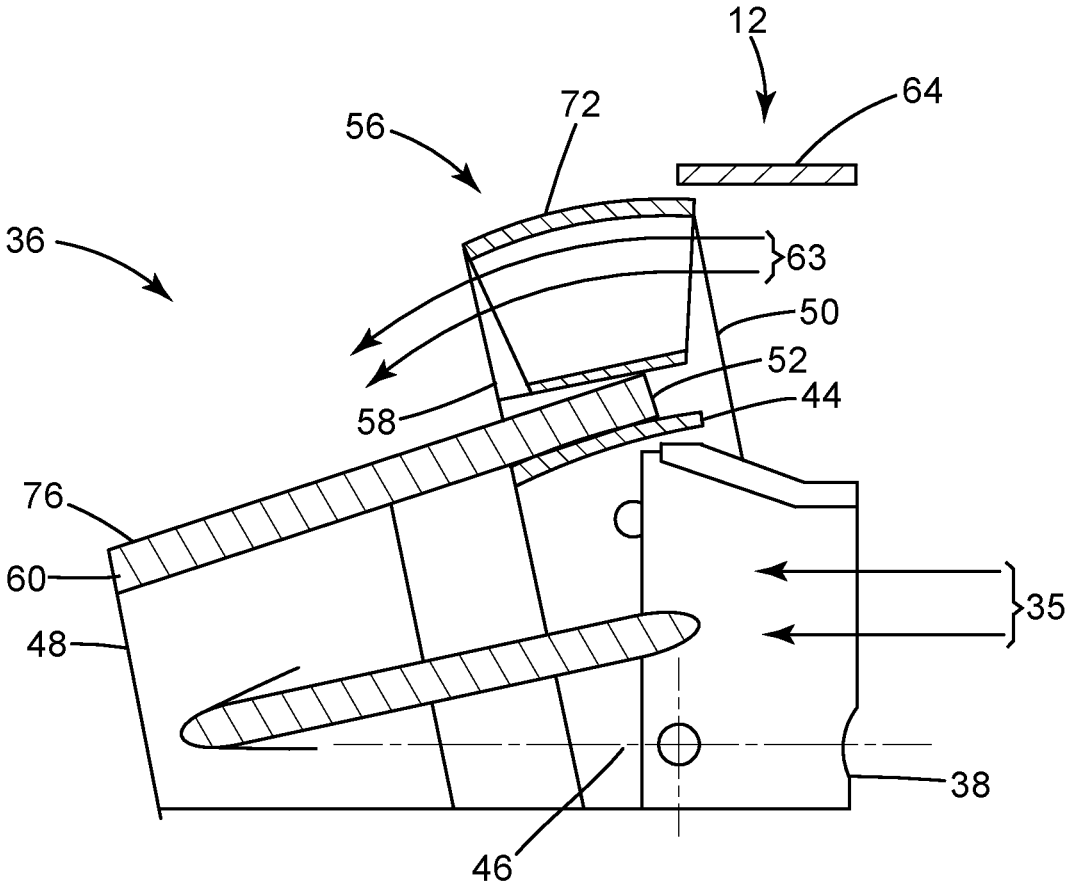
Figure 12:
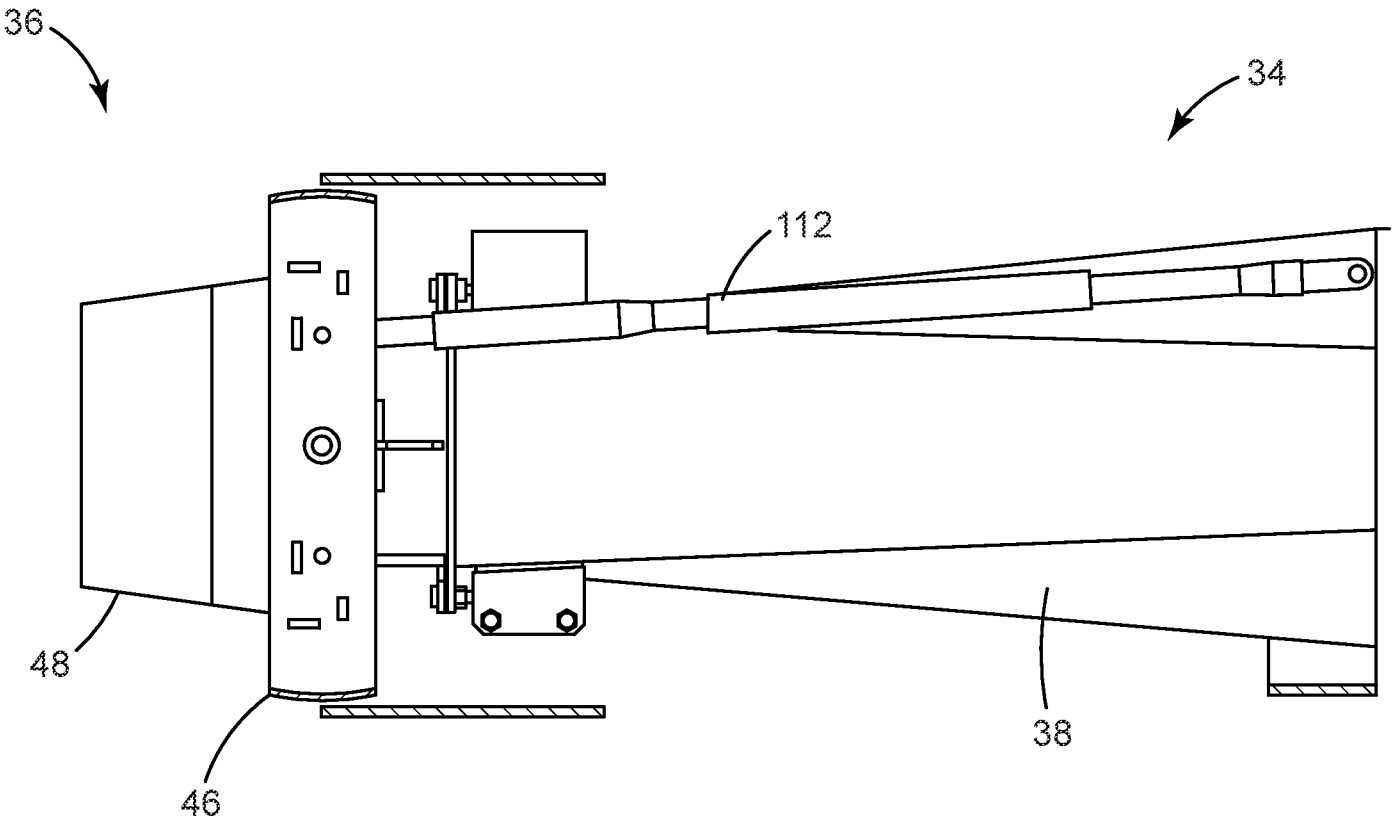

FIG. 9 is a side, cross-sectional view of a portion of the pulverized solid fuel nozzle tip assembly showing the seating of some of the supporting structures of the outer nozzle tip portion with the supporting structures of the inner nozzle tip portion that provide outer nozzle tip portion to inner nozzle tip portion contact surfaces at various locations that direct tilting forces used to tilt the inner nozzle tip portion during normal operation to be applied to the outer nozzle tip portion according to an embodiment of the present invention;

FIG. 10 is a side, cross-sectional view of a portion of the pulverized solid fuel nozzle tip assembly schematically showing a tilt range that is obtained by securing the inner nozzle tip portion to the outer nozzle tip portion with a pivot pin according to an embodiment of the present invention;

FIG. 11 is a side, cross-sectional view of a portion of the pulverized solid fuel nozzle tip assembly schematically showing a portion of the air shroud of the outer nozzle tip portion directing a stream of secondary air towards an outer surface of the inner nozzle tip portion according to an embodiment of the present invention; and FIG. 12 is a side, cross-sectional view of a pulverized solid fuel nozzle assembly with a pulverized solid fuel nozzle tip assembly and a tilting link arm to manipulate the nozzle tip assembly according to an embodiment of the present invention.

DETAILED DESCRIPTION

Example embodiments of the present invention will be described more fully hereinafter with reference to the accompanying drawings, in which some, but not all embodiments are shown. Indeed, the present invention may be embodied in many different forms and should not be construed as limited to the embodiments set forth herein; rather, these embodiments are provided so that this disclosure will satisfy applicable legal requirements. For like numbers may refer to like elements throughout.

Figure 1:
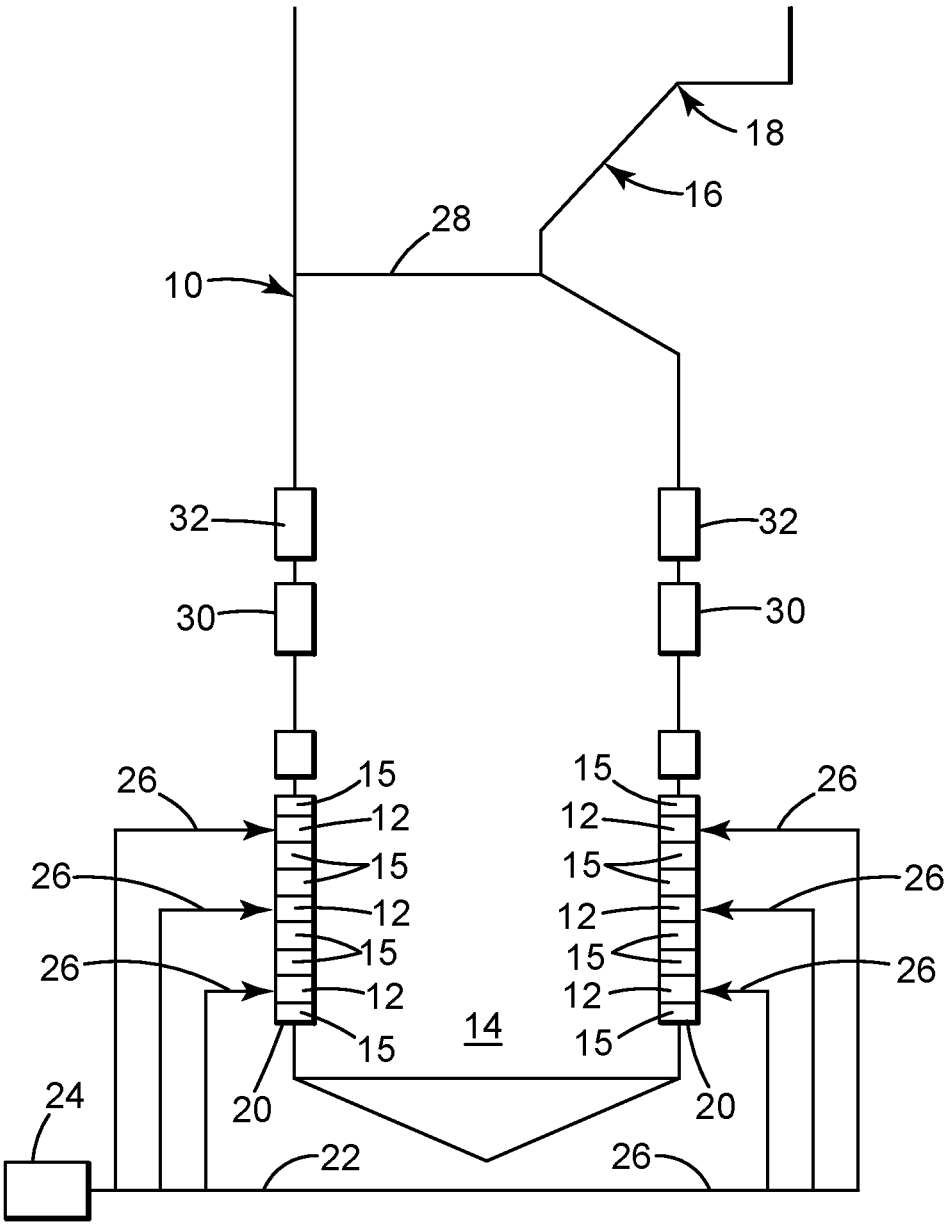
FIG. 1 is a schematic representation of a steam generator such as a pulverized solid fuel-fired boiler that produces steam that can be used in power generation with a steam driven generator according to an embodiment of the present invention.

Turning now to the figures, FIG. 1 shows a schematic of a steam generator 10 that produces steam that can be used for power generation with a steam driven generator according to an embodiment of the present invention. In one embodiment, the steam generator 10 can include a pulverized coal-based fired boiler. Although the various embodiments are described with respect to a pulverized coal-based fired boiler that utilizes pulverized coal to generate steam for power generation applications, it is understood that the pulverized solid fuel nozzle tip assembly of the embodiments described herein can be used with other pulverized solid fuel-fired boilers that utilize a nozzle and pulverized solid fuel nozzle tip assembly to issue a stream of pulverized solid fuel into a firing system or combustion chamber for combustion of the fuel. Examples can include, but are not limited to, pulverized solid fuel-fired boilers that utilize other pulverized solid fuels such as biomass, wood, peat, grains, and coke. Like pulverized coal-fired boilers, these other types of pulverized solid fuel-fired boilers can be harsh environments for the respective solid fuel nozzle tip assemblies that issue these solid fuels, due to the high temperatures in which the fuels are combusted and the abrasive nature of these fuels.

As shown in FIG. 1, the steam generator 10 can include a combustion chamber 14 within which the combustion of pulverized solid fuel (e.g., coal) and air is initiated. Hot gases that are produced from combustion of the pulverized solid fuel and air rise upwardly in the steam generator 10 and give up heat to fluid passing through tubes (not shown) that in conventional fashion line the walls of the steam generator. The hot gases can exit the steam generator 10 through a horizontal pass 16 of the steam generator 10, which in turn leads to a rear gas pass 18 of the steam generator 10. Both the horizontal pass 16 and the rear gas pass 18 may contain other heat exchanger surfaces (not shown) for generating and superheating steam in a manner well-known to those skilled in this art. The steam generated in the steam generator 10 may be made to flow to a turbine (not shown), such as used in a turbine/generator set (not shown) for power generation, or for any other desired purpose.

The steam generator 10 of FIG. 1 can also include one or more windboxes 20, which may be positioned in the corners of the steam generator 10. Each windbox 20 can have a plurality of air compartments 15 through which air supplied from a suitable source (e.g., a fan) is injected into the combustion chamber 14 of the steam generator 10. Also disposed in each windbox 20 is a plurality of fuel compartments 12, through which pulverized solid fuel is injected into the combustion chamber 14 of the steam generator 10.

The solid fuel is supplied to the fuel compartments 12 by a pulverized solid fuel supply 22, which includes a pulverizer 24 in fluid communication with the fuel compartments 12 via a plurality of pulverized solid fuel ducts 26. The pulverizer 24 is operatively connected to an air source (e.g., a fan), such that the air stream generated by the air source transports the pulverized solid fuel from the pulverizer 24, through the pulverized solid fuel ducts 26, through the fuel compartments 12, and into the combustion chamber 14 in a manner which is well known to those skilled in the art.

The steam generator 10 may be provided with two or more discrete levels of separated overfire air incorporated in each corner of the steam generator 10 so as to be located between the top of each windbox 20 and a boiler outlet plane 28 of the steam generator 10, thereby providing a low level of separated overtire air 30 and a high level of separated overtire air 32.

Figure 2:
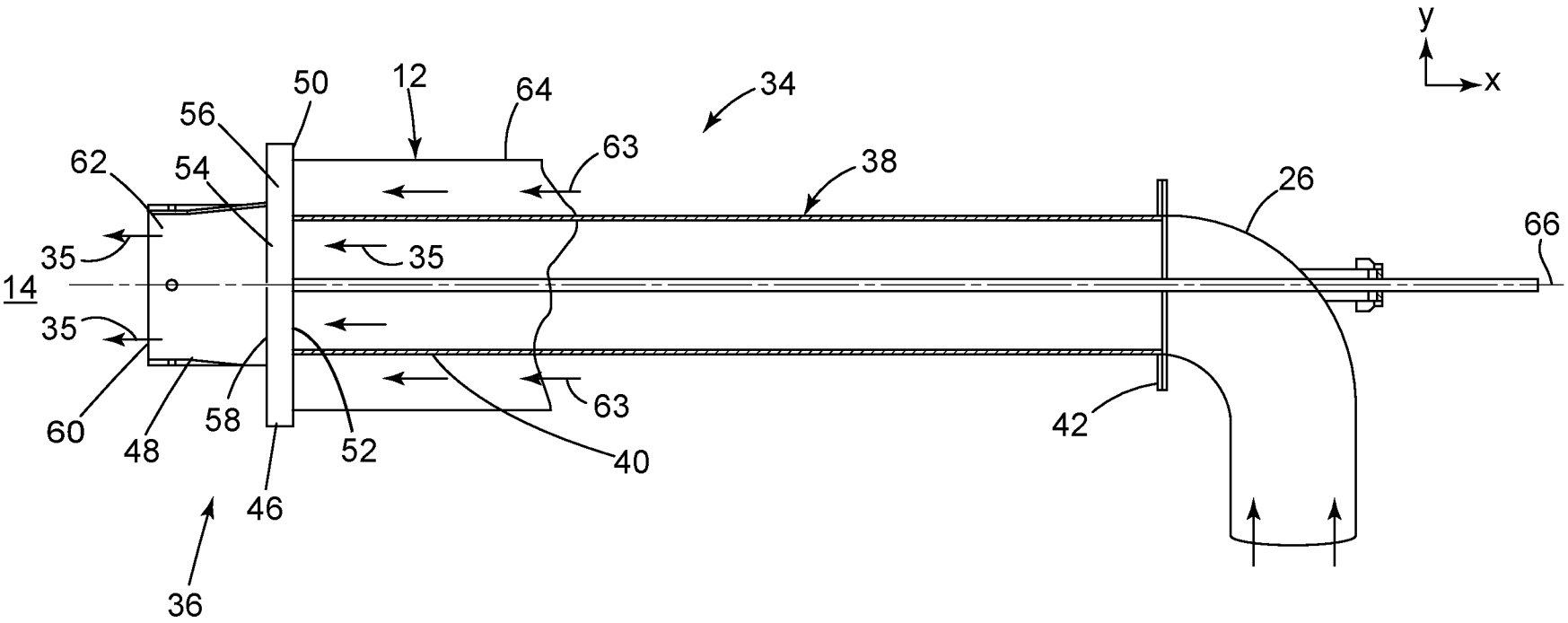
FIG. 2 is a schematic representation of a pulverized solid fuel nozzle assembly for providing a stream of pulverized solid fuel and air to the pulverized solid fuel-fired boiler depicted in FIG. 1 according to an embodiment of the present invention.

FIG. 2 is a schematic representation of a pulverized solid fuel nozzle assembly 34 for providing a stream of pulverized solid fuel and air 35 to a pulverized solid fuel-fired boiler like the steam generator 10 depicted in FIG. 1 according to an embodiment of the present invention. In particular, FIG. 2 shows a cross-sectional, elevation view of the pulverized solid fuel nozzle assembly 34 disposed within a fuel compartment 12 as taken along an x-y plane. While only one fuel compartment 12 is shown, it will be appreciated that each fuel compartment 12 of FIG. 1 may include a pulverized solid fuel nozzle assembly 34.

As shown in FIG. 2, the pulverized solid fuel nozzle assembly 34 can include a nozzle tip assembly 36, which protrudes into the combustion chamber 14, and a pulverized solid fuel pipe nozzle 38, which extends through the fuel compartment 12 and is coupled to a pulverized solid fuel duct 26. The pulverized solid fuel pipe nozzle 38 can comprise a generally rectangular or cylindrical shell 40 having a flange 42 disposed at one end for securing the pulverized solid fuel pipe nozzle 38 to the solid fuel duct 26, and a seal plate 44 (depicted in FIG. 11) disposed at the other end for providing a seal between the pulverized solid fuel pipe nozzle 38 and the nozzle tip assembly 36. By "generally rectangular," it is meant that the inner surface of the shell 40 provides a flow path having a rectangular cross-section throughout much of the length of the shell. It is also contemplated that the cross section of the shell 40 may be of a different shape, such as of a circular shape.

The nozzle tip assembly 36 comprises an outer nozzle tip portion 46 that can take the form of a frame adapted for mounting in supported relation with the pulverized solid fuel pipe nozzle 38 and a one-piece or monolithic, ceramic, inner nozzle tip portion 48 adapted for mounting within the outer nozzle tip portion 46. The outer nozzle tip portion 46 has an inlet end 50, an outlet end 58, a flow channel 54 extending therethrough from the inlet end to the outlet end, and an air shroud 56 with a plurality of air passages located about the inlet end, the outlet end, and the flow channel. The inner nozzle tip portion 48 has an inlet end 52, an outlet end 60, and a flow passageway 62 formed therebetween. The flow passageway 62 of the inner nozzle tip portion 48 is in fluid communication with the flow channel 54 of the outer nozzle tip portion 46. With this configuration, the inner nozzle tip portion 48 can receive the stream of pulverized solid fuel entrained in air 35 carried by the pulverized solid fuel pipe nozzle 38 for issuance to the combustion chamber 14 for combustion thereof, while the air passages of the air shroud 56 of the outer nozzle tip portion 46 can be operative to receive a stream of secondary air 63 provided by a secondary air conduit 64. In this manner, the secondary air can be used in the combustion in the combustion chamber, and to help cool the outer surfaces of the inner nozzle tip portion 48. Further details of the outer nozzle tip portion 46 and the inner nozzle tip portion 48 are provided below.

It is understood that the pulverized solid fuel nozzle assembly 34 can be suitably supported within a fuel compartment 12, and any conventional mounting technique may be employed. Also, the secondary air conduit 64 may be coaxially aligned with a longitudinal axis 66 of the shell 40, such that the pulverized solid fuel pipe nozzle 38 is centered within the secondary air conduit 64.

Figure 3:
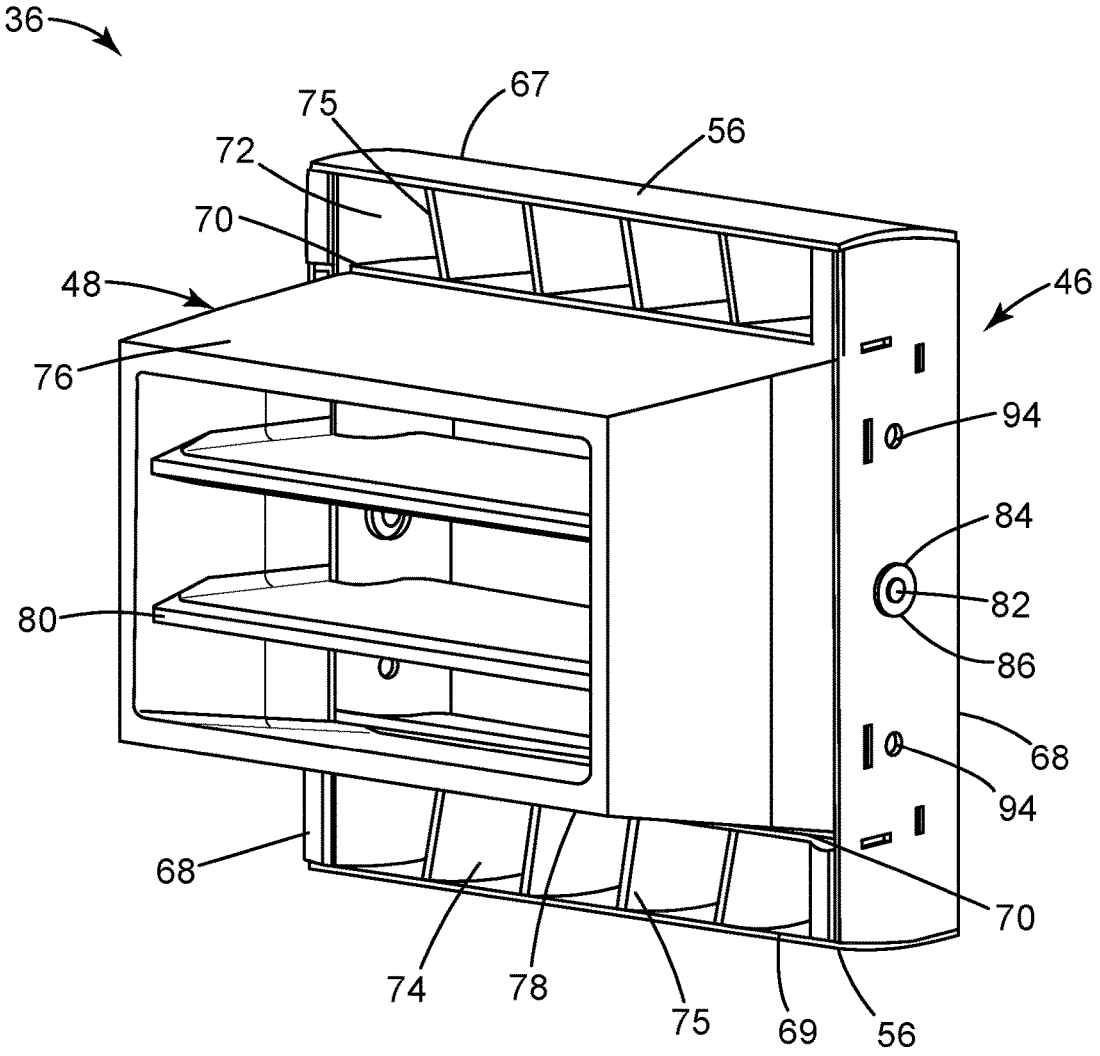
FIG. 3 is a more detailed view of a pulverized solid fuel nozzle tip assembly of the nozzle assembly depicted in FIG. 2 according to an embodiment of the present invention.

Also, it is contemplated that all or some of the components of the pulverized solid fuel nozzle assembly 34 may be dimensioned such that the nozzle assembly 34 can be used in place of an existing, prior art nozzle assembly. For example, it will be appreciated that the nozzle tip assembly 36 according to the various embodiments described herein can thus be retrofitted into an existing nozzle assembly of a steam generator with minimal modification to existing windbox controls or operation. It is also contemplated that the nozzle tip assembly 36 can be used with new nozzle assembly installations, FIG. 3 is a more detailed view of the pulverized solid fuel nozzle tip assembly 36 depicted in FIG. 2 according to an embodiment of the present invention. In particular, FIG. 3 shows further details associated with the outer nozzle tip portion 46, which can be referred to as a "driver" because it receives the forces from a tilting link arm 112 (e.g., FIG. 12) to manipulate the nozzle tip assembly through the full tilt range while minimizing the forces on the relatively brittle ceramic body, and the inner nozzle tip portion 48 of the nozzle tip assembly 36, which can be referred to as a "body" since a monolithic ceramic casting of this portion of the tip assembly delivers the mixed fuel and air mixture from the coal nozzle to the boiler. In addition to the features described in FIG. 2, the frame structure of the outer nozzle tip portion 46 is shown in FIG. 3 with a top wall 67, a bottom wall 69, a pair of opposing lateral sidewalls 68 between the top and bottom walls and a seal frame structure 70 located interior to the pair of opposing lateral sidewalls. As shown in FIG. 3, the air shroud 56, which is adapted to receive the secondary stream of air 63 (FIG. 2) from the secondary air conduit 64 (FIG. 2), can have a first plurality of air passages 72 located on the top of the seal frame structure 70, secured between the pair of opposing lateral sidewalls 68, and a second plurality of air passages 74 located under the bottom of the seal frame structure 70, secured between the pair of opposing lateral sidewalls 68. Both the first plurality of air passages 72 and the second plurality of air passages 74 are defined by spaced ribs 75 vertically disposed about the top and bottom of the seal frame structure 70 to produce different flow pathways for the secondary stream of air. In one embodiment, the first and second plurality of air passages 72, 74 of the air shroud 56 are operative to direct the secondary stream of air over an outer surface of the inner nozzle tip portion 48. For example, the first plurality of air passages 72 can direct a portion of the secondary air over a top surface 76 of the inner nozzle tip portion 48 and the second plurality of air passages 74 can direct another portion of the secondary air over a bottom surface 78 of the inner nozzle tip portion 48.

As shown in FIG. 3, the inner nozzle tip portion 48 can have at least one splitter plate 80 operative to divide and direct the stream of pulverized solid fuel and air 35 (FIG. 2) into different pathways. In one embodiment, the splitter plate(s) which can take the form of a baffle, can be disposed across the flow passageway 62 (FIG. 2) of the inner nozzle tip portion 48, aligned parallel to the longitudinal axis 66 (FIG. 2) to impart additional directional force to the stream of pulverized solid fuel and air to ensure a uniform distribution of the coal-air stream particularly when the nozzle tip assembly 36 is tilted away from a horizontal position.

In one embodiment, the inner nozzle tip portion 48 of the nozzle, tip assembly 36 can comprise a monolithic structure made of a cast ceramic. A cast ceramic, as opposed to stainless steel, allows the inner nozzle tip portion 48 to better withstand the high temperatures of the heat associated with the flame in the combustion chamber in which the inner nozzle tip portion is disposed. In addition, the use of a cast ceramic makes the inner nozzle tip portion 48 better suited to endure the highly abrasive nature of a pulverized solid fuel such as pulverized coal because of its high wear resistance. Examples of cast ceramic materials that are suitable for use with the inner nozzle tip portion 48 are ceramics that can include, but are not limited to, silicon nitride, siliconized silicon carbide, mullite bonded silicon carbide alumina composite, alumina zirconia composites, and alumina composite with optimized fiber. It is understood that the inner nozzle tip portion 48 can include other materials besides or in addition to a ceramic material.

The outer nozzle tip portion 46 of the nozzle tip assembly 36 can be formed from stainless steel. An advantage to having the outer nozzle tip portion 46 formed from stainless steel, as opposed to a ceramic like the inner nozzle tip portion 48, is that impact resistance and tensile strength of stainless steel will be greater than a ceramic. Since the outer nozzle tip portion 46 will be accommodating the loading demands imposed on the nozzle tip assembly 36 as explained below in more detail, it is advantageous to have the outer nozzle tip portion 46 formed from stainless steel. Nevertheless, it is understood that the outer nozzle tip portion 46 can include other materials besides stainless steel.

As mentioned above, the inner nozzle tip portion 48 can be tiltably secured to the outer nozzle tip portion 46 for longitudinal movement relative to the outer nozzle tip portion 46. As shown in FIG. 3, a pair of opposing pivot pins 82 can be utilized to secure the inner nozzle tip portion 48 to the lateral sidewalls 68 of the outer nozzle tip portion 46. In one embodiment, each of the pair of opposing pivot pins 82 can be positioned in a central location relative to the corresponding lateral sidewalls 68 and the seal frame structure 70 on a lateral centerline, to facilitate titling of the inner nozzle tip portion 48 over a predetermined a tilt range. The pair of opposing pivot pins 82 can be disposed in a pair of opposing pivot pin mounting bores 84, each extending through one of the corresponding lateral sidewalls 68 of the outer nozzle tip portion 46 and one of a pair of sidewalls of the inner nozzle tip portion 48. A pair of bushings 86 can each be placed in one of the opposing pivot pin mounting bores 84 to rotatably support one of the pivot pins 82. With this arrangement, and suitable dimensions (e.g. thickness, diameters) for the pivot pins 82, the pivot pin mounting bores 84, and the bushings 86, the loads placed upon the nozzle tip assembly 36 during normal operation can be distributed in a load equalizing manner which reduces the risk that the tip assembly 36 will catastrophically fail due to point loading during tilting of the tip assembly.

In addition, this mounting arrangement for mounting the inner nozzle tip portion 48 to the outer nozzle tip portion 46 is advantageous for the nozzle tip assembly 36 in that it allows the tip assembly to successfully withstand the typical loading imposed during normal operation in the combustion chamber of the steam generator. This includes the loading imposed by tilting of the nozzle tip assembly 36 by a nozzle tip tilt link mechanism that can include for example a tilting link arm (FIGS. 4-10 and 12—reference element 112). Further, the impact resistance and tensile strength of the nozzle tip assembly 36 through the outer nozzle tip portion 46, which as mentioned previously can be formed of stainless steel, and the inner nozzle tip portion 48, which as mentioned previously can be formed of a ceramic material, afford the nozzle tip assembly 36 with high wear resistance and tolerance of extremely high temperatures.

Figure 4:
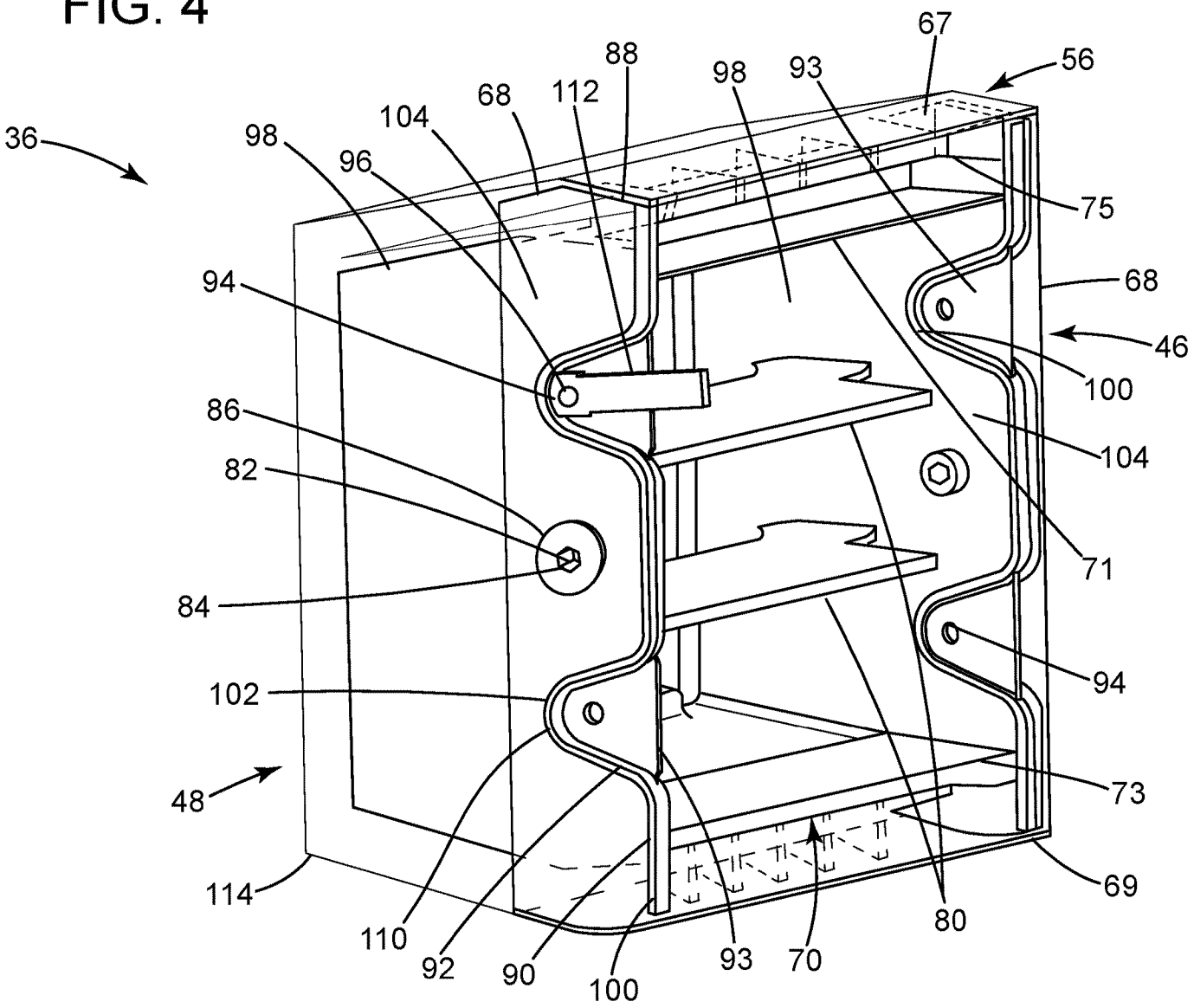
FIG. 4 is a rear view schematic of the pulverized solid fuel nozzle tip assembly depicted in FIG. 3 that shows more details of the outer nozzle tip portion and the inner nozzle tip portion according to an embodiment of the present invention.
Figure 5:
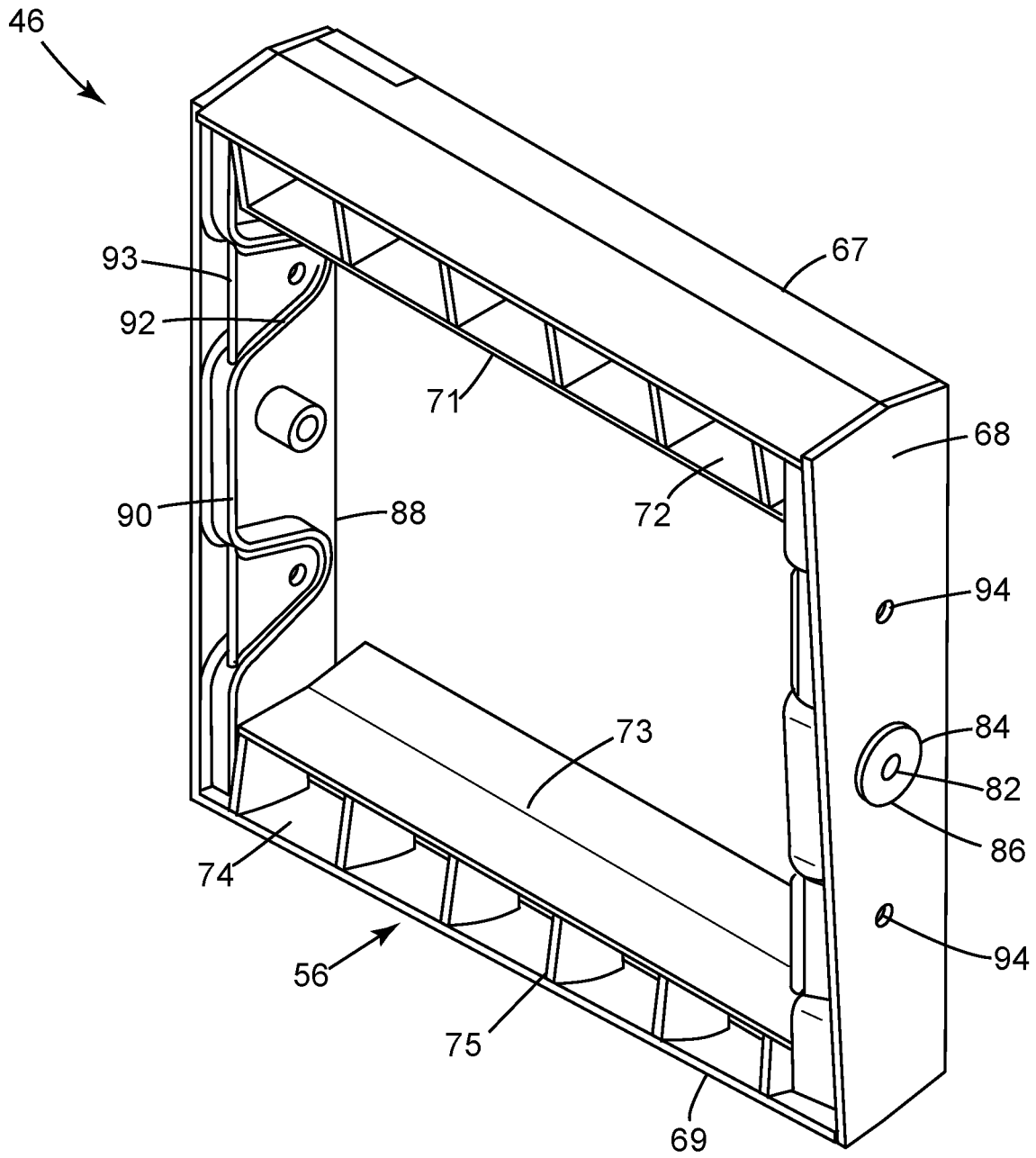
FIG. 5 is a schematic of a rear perspective view of the frame of the outer nozzle tip portion according to an embodiment of the present invention.
Figure 6:
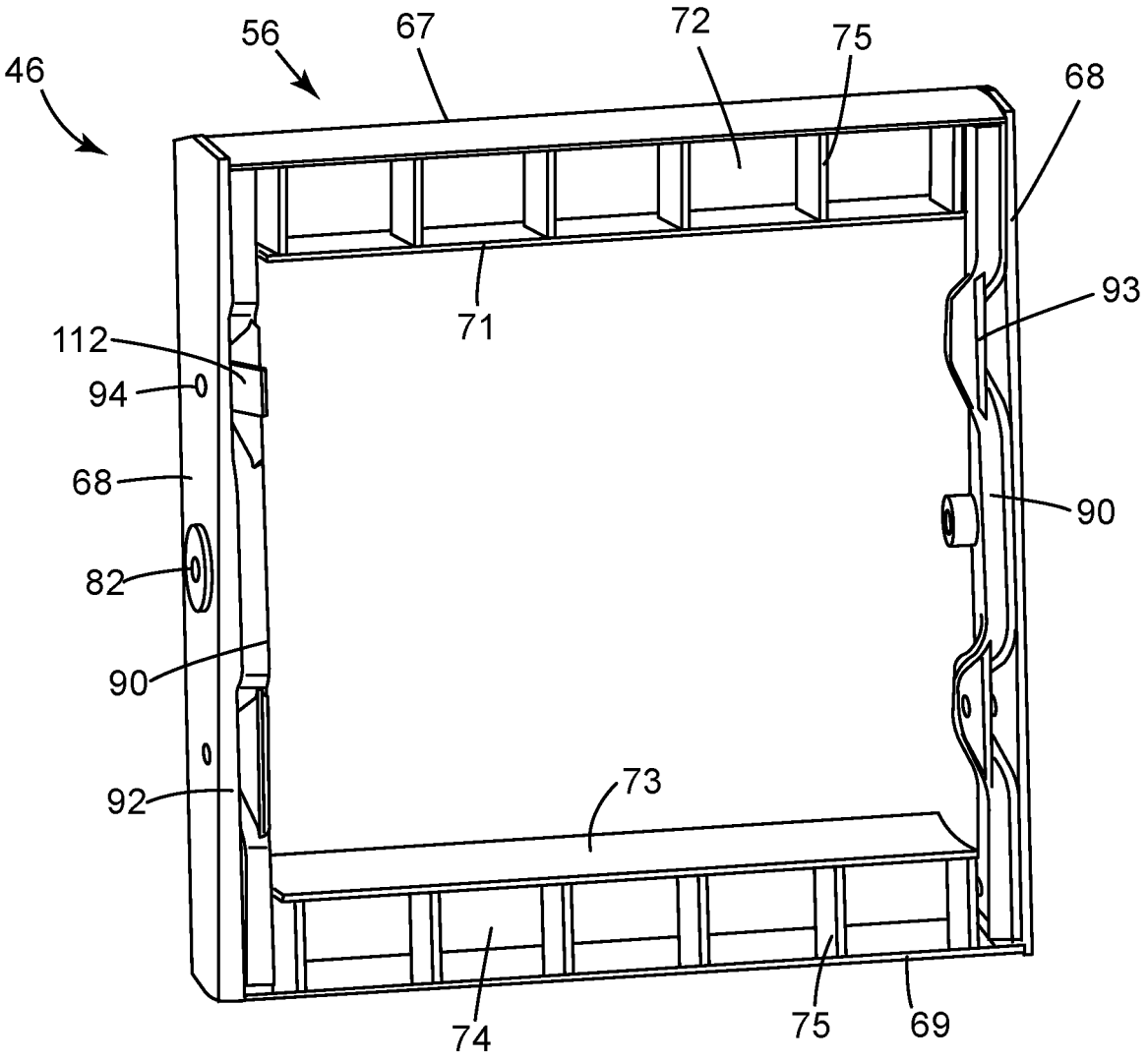
FIG. 6 is a schematic of another rear perspective view of the frame of the outer nozzle tip portion according to an embodiment of the present invention.
Figure 7:
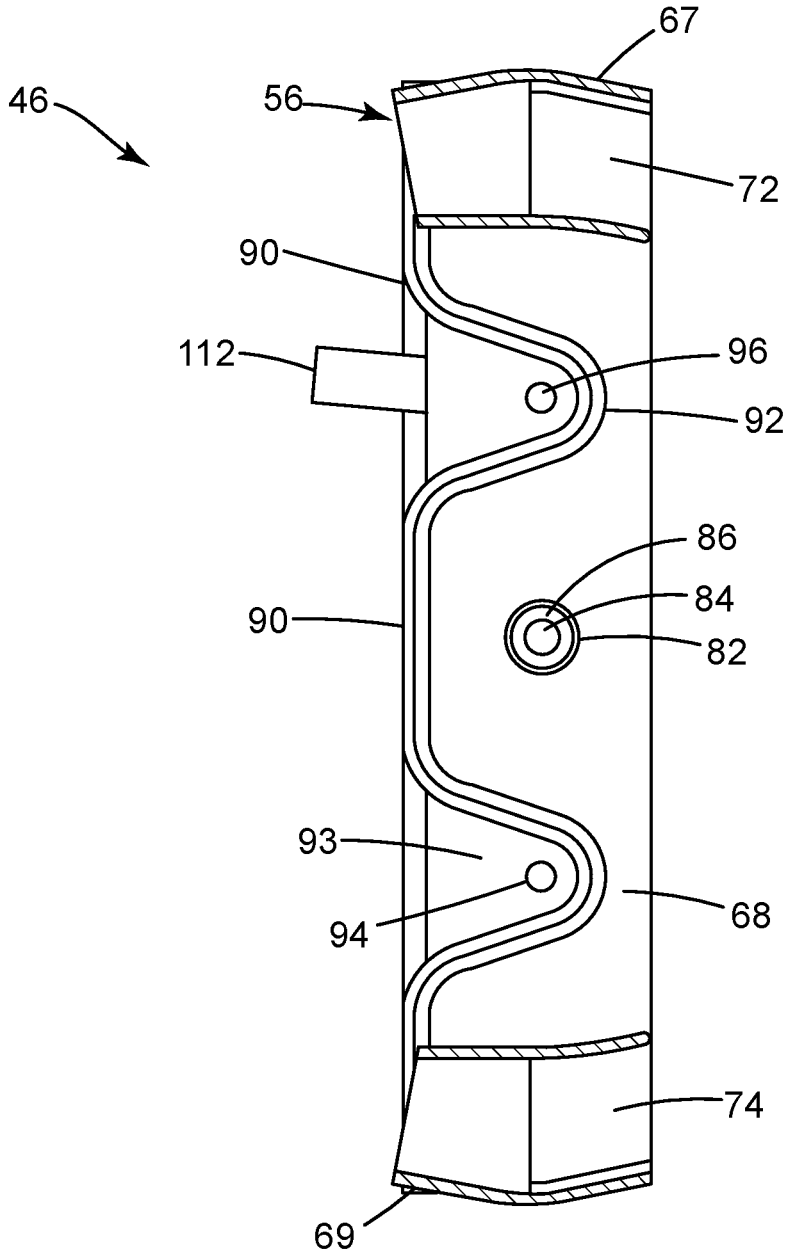
FIG. 7 is a schematic of a side elevational view of the frame of the outer nozzle tip portion according to an embodiment of the present invention.

FIG. 4 is a rear view schematic of the pulverized solid fuel nozzle tip assembly 36 depicted in FIG. 3 that shows more details of the outer nozzle tip portion 46 and the inner nozzle tip portion 48 according to an embodiment of the present invention. For example, FIG. 4 along with FIGS. 5-7 show further details of the frame that forms the outer nozzle tip portion 46 including the pair of opposing lateral sidewalls 68, and the top wall 67 and the bottom wall 69 that join the sidewalls. As shown in FIG. 4, each of the opposing lateral sidewalls 68 can include a front surface 88 having a contoured profile defining a plurality of spaced recess portions 90 with nose portions 92 (e.g., rims or protrusions) formed therebetween.

FIG. 4 shows that the outer nozzle tip portion 46 can include a plurality of inset lug plates 93 coupled to the pair of opposing lateral sidewalls 68. As used herein, a plurality of inset lug plates means one or more lug plates 93. In one embodiment, each inset lug plate 93 is disposed flush (i.e., in the same plane or substantially the same plane) with or against one of the nose portions 92 in each of the opposing lateral sidewalls 68 so that the lug plates are immediately adjacent or directly abutting a surface of the nose portions. As shown in FIGS. 4, 5, 6 and 7, each of the plurality of inset lug plates 93 can comprise a shape with a profile that matches with one of the nose portions 92 on the front surfaces 88 of each of the opposing lateral sidewalls 68 of the outer nozzle tip portion 46. Having the inset lug plates with a profile of a shape that matches with the nose portions 92 means that each of the inset lug plates has a shape that is approximately the same geometric surface profile as the nose portion that it is most adjacent to. In one embodiment, the inset lug plates 93 can be coupled to corresponding nose portions 92 on the front surfaces 88 of each of the opposing lateral sidewalls 68 of the outer nozzle tip portion 46 by using any of number of well-known fastening approaches that include, but are not limited to, welding, bonding, and bolting.

Although the inset lug plates 93 are described as being disposed flush with or against the nose portions 92 in each of the opposing lateral sidewalls 68, it is understood that there can be slight gaps between each of these elements in order to provide room or clearance therebetween. In this manner, a slight gap between the inset lug plates 93 and the nose portions 92 can provide sufficient clearance between the elements to ensure that the inner nozzle tip portion 48 can tilt up and down in response to the driving forces provided by the outer nozzle tip portion 46.

The plurality of inset lug plates 93, which can also be referred to as tilting link arm pin support plates, can be used to facilitate coupling of a tilting link arm 112 to the nozzle tip assembly to drive the secure tilting of the inner nozzle tip portion 48 in relation to the outer nozzle tip portion 46. The particular inset lug plate 93, which is used to enable the coupling of the tilting link arm 112 to a specific nose portion 92 of the lateral sidewall 68 of the outer nozzle tip portion 46, can receive a tilting link arm pivot pin (not shown in FIG. 4) therein to facilitate the coupling of the tilting link arm 112 and the inset lug plate in double shear. Having the tilting link arm pivot pin in double shear allows the pin to handle excessive stresses (e.g., excessive twisting, deformations and force reactions), Without the inset lug plate 93, having the tilting link arm pivot pin only in a nose portion of the lateral sidewall would lead to a failure of the pin during operation due to the excessive stresses because the pin would essentially be in a cantilever configuration.

FIG. 4 also shows details of the seal frame structure 70 of the outer nozzle tip portion 46. In one embodiment, as shown in FIG. 4, the seal frame structure can include the air shroud 56 and an optional inner nozzle tip protection part 114 that can extend from a top plate 71 and a bottom plate 73 of the seal frame structure 70 over the top surface 76 and the bottom surface 78 of the inner nozzle tip portion 48, respectively. In this manner, the optional inner nozzle tip protection part 114 that extends from the top plate 71 and the bottom plate 73 can serve to protect the monolithic, ceramic inner nozzle tip portion 48 from items that can include, but are not limited to, slag falling from the furnace walls. In addition, the optional inner nozzle tip protection part 114 can receive the secondary stream of air from the first and second plurality of air passages 72 and 74 (FIG. 3) of the air shroud 56.

As shown in FIG. 4, the seal frame structure 70 can be located interior to the pair of opposing lateral sidewalls 68, with the top plate 71 and the bottom plate 73 spaced apart from the top plate. To this extent, the top plate 71 and the bottom plate 73 can have contact with the pulverized solid fuel pipe nozzle 38 (FIG. 2) to provide a seal between the nozzle tip assembly 36 and the solid fuel pipe nozzle 38. With this configuration, the seal frame structure 70 goes around the pulverized solid fuel pipe nozzle 38 to keep the pulverized fuel interior to the inner nozzle tip portion 48, and to keep the secondary air 63 in the outer nozzle tip portion 46. In this manner, the nozzle tip assembly 36 will be able to tilt forward and back such there will be no gap between the nozzle tip assembly 36 and the pulverized solid fuel pipe nozzle 38 that could result in the solid fuel (e.g., coal) falling therethrough. In one embodiment, the top plate 71 and the bottom plate 73 can include rolled plates or seal blades that extend horizontally between the pair of opposing lateral sidewalls 68. For example, the top plate 71 and the bottom plate 73 of the seal frame structure 70 are each transversely oriented to adjacent recess portions 90 on the front surfaces 88 of the opposing lateral sidewalls 68 of the outer nozzle tip portion 46.

In one embodiment, as shown in FIG. 6, the top plate 71 and the bottom plate 73 can terminate before contacting the lateral sidewalls 68. Although FIG. 6 shows the top plate 71 and the bottom plate 73 terminating before the lateral sidewalls 68 without contact therewith, it is understood that these plates can be coupled to the sidewalls 68.

In one embodiment, the top plate 71 and the bottom plate 73 can form part of the air shroud 56. For example, the top plate 71 can act as a base to support the ribs 75 of the air shroud 56 which define the first plurality of air passages 72, whereas the bottom plate 73 can act as a top surface to support the ribs 75 of the air shroud 56 which define the second plurality of air passages 74.

As shown in FIG. 4, the inner nozzle tip portion 48 includes a pair of opposing sidewalls 98. Each of the opposing sidewalls 98 has a back surface 100 with a contoured profile defining a plurality of spaced recess portions 102 (FIG. 8) with nose portions 104 (FIG. 8) formed therebetween. The nose portions 104 (FIG. 8) on the back surfaces 100 of the opposing sidewalls 98 of the inner nozzle tip portion 48 can be seated correspondingly in the recess portions 90 on the front surfaces 88 of the opposing lateral sidewalls 68 of the outer nozzle tip portion 46. In addition, the nose portions 92 and the respective inset lug plates 93 on the front surfaces 88 of the opposing lateral sidewalls 68 of the outer nozzle tip portion 46 can be seated correspondingly in the recess portions 102 on the back surfaces 100 of the sidewalls 98 of the inner nozzle tip portion 48.

Figure 8:
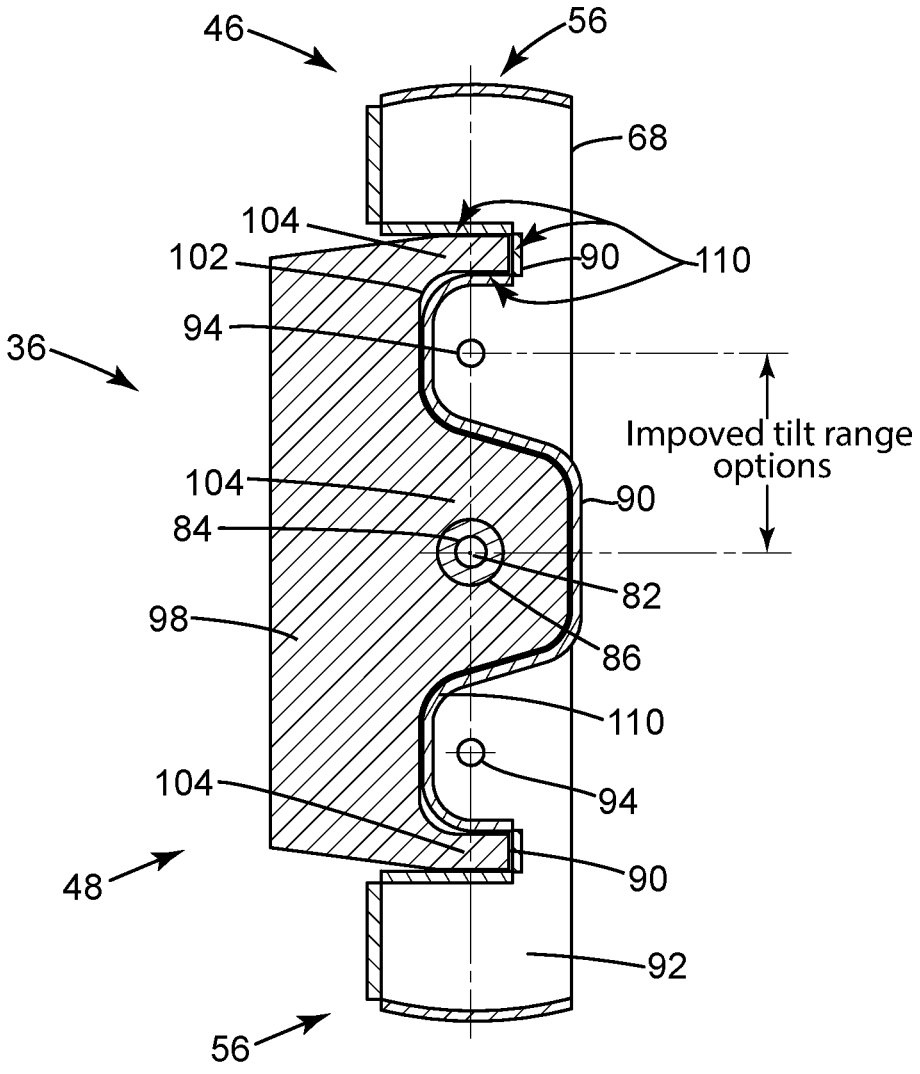
FIG. 8 is a side, cross-sectional view of a portion of the pulverized solid fuel nozzle tip assembly depicted in FIG. 3 with further details showing the inner nozzle tip portion secured to the outer nozzle tip portion according to an embodiment of the present invention.

The seating of the nose portions 104 (FIG. 8) on the back surfaces 100 of the opposing sidewalls 98 of the inner nozzle tip portion 48 in the recess portions on the front surfaces 88 of the opposing lateral sidewalls 68 of the outer nozzle tip portion 46 and the seating of the nose portions 92 and respective inset lug plates 93 on the front surfaces 88 of the opposing lateral sidewalls 68 of the outer nozzle tip portion 46 in the recess portions 102 (FIG. 8) on the back surfaces 100 of the opposing sidewalls 98 of the inner nozzle tip portion 48 provide an outer nozzle tip portion to inner nozzle tip portion contact surface 110 (FIG. 8). As discussed below in more detail, the outer nozzle tip portion to inner nozzle tip portion contact surface 110 (FIG. 8) directs tilting forces used to tilt the inner nozzle tip portion 48 to be applied to the outer nozzle tip portion 46. In this manner, the tilting forces applied to the inner nozzle tip portion 48 can be minimized.

The pair of opposing pivot pins 82 can be utilized to secure the sidewalls 98 of the inner nozzle tip portion 48 to the lateral sidewalls 68 of the outer nozzle tip portion 46. As noted above, the pair of opposing pivot pins 82 can be disposed in the pair of opposing pivot pin mounting bores 84. In this manner, each pivot pin 82 can extend through one of the corresponding lateral sidewalls 68 of the outer nozzle tip portion 46 and one of the pair of sidewalls 98 of the inner nozzle tip portion 48. The pair of bushings 86 can each be placed in one of the opposing pivot pin mounting bores 84 to rotatably support one of the pivot pins 82. As explained below in more detail, with this arrangement and suitable dimensions (e.g. thickness, diameters) for the pivot pins 82, the pivot pin mounting bores 84, and the bushings 86, the loads placed upon the nozzle tip assembly 36 during normal operation can be distributed in a load equalizing manner which reduces the risk that the tip assembly 36 will catastrophically fail due to point loading during tilting of the tip assembly.

As shown in FIGS. 3-8 each of the lateral outer sidewalls 68 of the outer nozzle tip portion 46 can have a pair of tilting link arm mounting bores 94 formed thereon. In one embodiment, the tilting link arm mounting bores 94 can be formed in the nose portions 92 on the lateral sidewalls 68 of the outer nozzle tip portion 46. The inset lug plates 93 that are flush with the nose portion 92 can also have tilting link arm mounting bores that align with the bores in the nose portions. With the arrangement of tilting link arm mounting bores 94 in the nose portions 92 and the inset lug plates 93 on the lateral sidewalls 68, the tilting link arm 112 can be secured to one of the nose portions and its respective inset lug plate 93 via the bore 94. In one embodiment, a fastener assembly can be used to secure the tilting link arm 112 to the designated nose portion 92 and inset lug plate 93. A tilting link arm pivot pin 96 is one example of a particular fastener that can be used to secure the tilting link arm 112 to the bores 94 of the designated nose portion 92 and inset lug plate 93 of one of the lateral sidewalls 68 of the outer nozzle tip portion 46. In operation, the tilting link arm pivot pin 96 can extend through the tilting link arm mounting bore 94 in the designated nose portion 92 and respective inset lug plate 93. Extending the tilting link arm pivot pin 96 through both the nose portion 92 and the respective inset lug plate 93 in this manner will place the pin 96 in double shear. To this extent, movement of the tilting link arm 112 will cause the outer nozzle tip portion 46 to securely drive the inner nozzle Up portion 48 to tilt up and down about the pulverized solid fuel pipe nozzle 38 in a desired manner.

It is understood that the tilting link arm pivot pin 96 is illustrative of one possible fastener assembly that can be used to secure the tilting link arm 112 to the lateral sidewalls 68 of the outer nozzle tip portion and is not meant to be limiting. Some other examples of fastener assemblies that can be used include, but are not limited to, castings, fabricated sheet-metal and 3D printed assemblies.

Further, it is understood that the use of the inset lug plates 93 in the lateral sidewalls of the frame of the outer nozzle tip portion represents only one possible approach that can be utilized that precludes the use of extraneous elements that are subject to thermal expansion that leads to cracking in the inner nozzle tip portion. Those skilled in the art will appreciate that other elements can be added or used in place of the inset lug plates 93.

As shown in FIGS. 3-5, 7, and 8, each of the tilting link arm mounting bores 94 in the pair of bores on each lateral sidewall 68 of the outer nozzle tip portion can be vertically spaced apart from one another. In one embodiment, as shown in FIGS. 3-5, 7, and 8, the tilting link arm mounting bores 94 can be in vertical alignment with the centrally located pivot pin mounting bores 84. In other embodiments, the tilting link arm mounting bores 94 can be offset from the pivot pin mounting bores 84, and not in vertical alignment.

As mentioned above, each of the pair of opposing pivot pins 82 can be positioned in a central location relative to the corresponding lateral sidewalls 68 of the outer nozzle tip portion 46 to facilitate titling of the inner nozzle tip portion 48 over a predetermined a tilt range. FIG. 8 shows further details of this feature. In particular, FIG. 8 shows the pivot pin mounting bores 84, which can receive the pivot pins 82 and the bushings 86, can be positioned in a central location relative to the corresponding lateral outer sidewalls 68 of the outer nozzle tip portion 46 and the sidewalls 98 of the inner nozzle tip portion 48 on a lateral centerline to these components.

FIG. 8 also shows further details of the supporting structures (e.g., the nose portions and the recess portions) of both the outer nozzle tip portion 46 and the inner nozzle tip portion 48. In particular, FIG. 8 shows how the complementary surfaces of the supporting structures operate cooperatively to maintain support of the inner nozzle tip portion 48 within the outer nozzle tip portion 46 during normal boiler operation. The seating of the noses 104 of the inner nozzle tip portion 48 in the recesses 90 of the outer nozzle tip portion 46, and the seating of the noses 92 of the outer nozzle tip portion in the recesses 102 of the inner nozzle tip portion results in the outer nozzle tip portion to inner nozzle tip portion contact surface 110 at various locations of the interface between the components.

In one embodiment, as shown in the example provided in FIG. 8, the recesses 102 on the back surface of the inner nozzle tip portion 48 can include a lower recess at a lower heightwise location along the back surface and an upper recess at an upper heightwise location. A recess 90 on the front surface of the outer nozzle tip portion 46 can be juxtaposed between the lower recess and the upper recess of the inner nozzle tip portion 48 when the two nozzle tip portions are coupled together. In one embodiment, the recess on the front surface of the outer nozzle tip portion can have a depth and a width that is greater than the depth and width of the lower recess and the upper recess. Similarly, the noses 104 on the back surface of the inner nozzle tip portion 48 can include a lower nose at a lower heightwise location along the sidewalls 98 and an upper nose at an upper heightwise location. Noses 92 on the front surface of the outer nozzle tip portion 46 can be juxtaposed between the lower nose and the upper nose of the inner nozzle tip portion 48 when the two nozzle tip portions are coupled together. In one embodiment, the noses 92 on the front surface of the outer nozzle tip portion 46 can each have a width that is greater than the widths of the lower nose and the upper nose on the inner nozzle tip portion 48.

With these respective supporting structures, the inner nozzle tip portion 48 can be mounted securely within the outer nozzle tip portion 46 as shown in FIG. 8. In particular, the corresponding seating of the noses on the back surfaces of the inner nozzle tip portion 48 in the recesses on the front surfaces of the outer nozzle tip portion 48, and the noses on the front surfaces of the outer nozzle tip portion in the recesses on the back surfaces of the inner nozzle tip portion result in the outer nozzle tip portion to inner nozzle tip portion contact surface 110 at various locations along the interface between these components.

It is understood that the number of recesses and noses illustrated herein for both the outer nozzle tip portion 46 and the inner nozzle tip portion 48 is only illustrative. Those skilled in the art will appreciate that the outer nozzle tip portion 46 and the inner nozzle tip portion 48 can be contoured to have additional or fewer noses and recesses. In addition, it is understood that the dimensions (e.g., widths and thicknesses can also vary. Moreover, it is understood that the outer nozzle tip portion 46 and the inner nozzle tip portion 48 can be profiled with other shapes to facilitate a secure mounting between these nozzle tip components.

Not only do the aforementioned supporting structures of the inner nozzle tip portion 48 (i.e., the contoured back surface of the sidewalls 98) and the outer nozzle tip portion 46 (i.e., the contoured front surface of the lateral sidewalls 68) enable the inner nozzle tip portion 48 to be mounted securely within the outer nozzle tip portion 46, but these supporting structures also have a further benefit in that the outer nozzle tip portion to inner nozzle tip portion contact surfaces 110 can direct tilting forces used to tilt the inner nozzle tip portion 48 during normal operation to be applied to the outer nozzle tip portion 46. This minimizes the tilting forces applied to the inner nozzle tip portion 48 that can lead to point contact loading and stress to the inner nozzle tip portion 46.

FIG. 9 is a side, cross-sectional view of a portion of the pulverized solid fuel nozzle tip assembly 36 showing the beneficial effect that the outer nozzle tip portion to inner nozzle tip portion contact surfaces 110 can have with respect to directing tilting forces used to tilt the inner nozzle tip portion 48 to be applied to the outer nozzle tip portion 46. For example, FIG. 9 shows in one embodiment that the outer nozzle tip portion to inner nozzle tip portion contact surfaces 110 about the central recesses and central noses of the supporting structures of the outer nozzle tip portion 46 and the inner nozzle tip portion 48 will bear a majority of the forces used to tilt the inner nozzle tip portion 48. This is due to the relatively large surface area associated with this contact surface 110 because of the thicknesses and depths of the corresponding noses and recesses at this location. That is, because the supporting structures of the outer nozzle tip portion 46 are designed with maximized surface areas; the outer nozzle tip portion 46 can reduce the tilting forces that can damage the inner nozzle tip portion 48.

In another embodiment, the outer nozzle tip portion to inner nozzle tip portion contact surfaces 110 about the upper recesses and upper noses of the supporting structures of the outer nozzle tip portion 46 and the inner nozzle tip portion 48 can contribute with the bearing surfaces about the central locations to bear a majority of the forces used to tilt the inner nozzle tip portion 48.

Because the inner nozzle tip portion 48 is pinned at a center point, via the pivot pins 82 and bushings 86, with a large surface area pin, and "driven" by large contact areas on the inlet end 52 (FIG. 2) of the inner nozzle tip portion 48, movement or tilting of the inner nozzle tip portion 48 can be accomplished in a manner that directs forces needed to tilt the nozzle tip assembly 36 to be applied to the outer nozzle tip portion 46 (i.e., the driver). This increases the bearing surface to the single or monolithic, ceramic front piece (i.e., the inner nozzle tip portion 48). As a result, the possibility of point contact loading that could over stress the ceramics associated with the inner nozzle tip portion 48 is reduced. Moreover, because the inner nozzle tip portion 48 only needs to pivot its own mass due to the aforementioned method of attachment, the inner nozzle tip portion 48 will encounter little to no forces from the tilting mechanism (e.g., a tilting link arm, which is to be attached to the outer nozzle tip portion 46 and used to manipulate tilting) during the tilting of the nozzle tip assembly 36, FIG. 10 is a side, cross-sectional view of a portion of the pulverized solid fuel nozzle tip assembly 36 schematically showing a tilt range that is obtained by securing the inner nozzle tip portion 48 to the outer nozzle tip portion 46 with a pivot pin 82. The tilt range according to the various embodiments can be dictated by the distance of the sidewall interconnecting bore 94 from the pivot pin 82. For example, FIG. 10 shows that having the pivot pin 82 closer to the sidewall interconnecting bore 94 will result in an increased tilt range. Accordingly, multiple tilt positions can be obtained by varying the position of the sidewall interconnecting bores 94 versus the pivot pins 82. In this manner, the various embodiments of the nozzle tip assembly 36 can have a predetermined tilt range that covers a wide range of tilt positions for the outer nozzle tip portion 46 that can be imparted to the inner nozzle tip portion 46.

This wide range of tilt positions is an improvement over the tilt ranges of conventional ceramic nozzle tip assemblies. In particular, the tilt angle can be modified by relocating the link arm attachment location in the driver (i.e., outer nozzle tip portion 46). This can save time and money by not having to modify the mold used to produce the ceramic body (i.e., inner nozzle tip portion 48) for different tilt range requirement.

FIG. 11 is a side, cross-sectional view of a portion of the pulverized solid fuel nozzle tip assembly 36 schematically showing a portion of the air shroud 56 of the outer nozzle tip portion 46 directing a stream of secondary air 63 towards an outer surface of the inner nozzle tip portion 48. As shown in FIG. 11, the first plurality of air passages 72 of the air shroud 56 can direct the stream of secondary air 63 towards the top outer surface 76 of the inner nozzle tip portion 48. In one embodiment, the first plurality of air passages 72 of the air shroud 56 can be configured with a curved outer portion to deflect the stream of secondary air 63 over the top surface 76 of the inner nozzle tip portion 48.

In this manner, the stream of secondary air 63 deflected towards the top outer surface 76 of the inner nozzle tip portion 48 by the curved outer portion of the passages 72 of the air shroud 56 will help with cooling the pulverized solid fuel nozzle tip assembly 36 when it is in a tilted or horizontal orientation as manipulated by the tilting link arm 112, of which is shown in more detail in FIG. 12. In the example illustrated in FIG. 11, the tilting link arm 112 of FIG. 12 can be manipulated to operate the pulverized solid fuel nozzle tip assembly 36 in a downward pointed direction in relation to the pulverized solid fuel pipe nozzle 38, which carries the stream of pulverized solid fuel and air 35, and the secondary air conduit 64, which provides the stream of secondary air 63, both of which are in a fuel compartment 12.

It is understood that the level of cooling of the outer surface of the inner nozzle tip portion 48 by the passages 72 can be dictated by other features associated with these features. For example, the number of passages, the size of the passages, the materials of the passages, and shapes of the passages can all have a role in the degree of cooling that is provided to the outer surface of the inner nozzle tip portion 48.

Although not depicted in FIG. 11, it is understood that the secondary plurality of air passages 74 of the air shroud 56 shown in FIG. 3 that are adapted to direct the stream of secondary stream air 63 towards the bottom surface 78 of the inner nozzle tip portion 48 may operate in a similar manner as shown in FIG. 11. That is, the secondary plurality of air passages 74 of the air shroud 56 may be configured with a curved outer portion to deflect the stream secondary air 63 towards the bottom surface 78 of the inner nozzle tip portion 48.

There are several technical effects associated with the various embodiments. First, the pulverized solid fuel nozzle tip assembly of the various embodiments has a high wear resistance due to the use of a ceramic material with the inner nozzle tip portion. Ceramics, as opposed to stainless steel, is better suited to withstand the high temperatures of the heat associated with the flame in the combustion chamber in which the inner nozzle tip portion is disposed. In addition, the use of ceramics with the inner nozzle tip portion is better suited to endure the highly abrasive pulverized coal because of its high wear resistance. This ensures that the pulverized solid fuel nozzle tip assembly of the various embodiments can work for a longer period of time without the need for more frequent servicing. Accordingly, the pulverized solid fuel nozzle tip assembly of the various embodiments is expected to have an increased service life with reduced maintenance costs in comparison to the typical solid fuel nozzle tip assembly that has a low wear resistance, a shorter overall service life cycle, and more maintenance costs due to the servicing that is needed because of its low wear resistance from operating in an extremely harsh environment.

Other technical effects associated with the pulverized solid fuel nozzle tip assembly of the various embodiments is that it provides an enhanced tilt range due to the use and positioning of the pivot pins, the pin mounting bores, and the bushings that tiltably secure the inner nozzle tip portion to the outer nozzle tip portion.

In addition to providing an enhanced tilt range, the pulverized solid fuel nozzle tip assembly of the various embodiments minimize the tilting forces that cause damage to the typical pulverized solid fuel nozzle tip assembly. In particular, the supporting structures of the outer nozzle tip portion and the inner nozzle tip portion, and their complementary surfaces, maintain support of the inner nozzle tip portion within the outer nozzle tip portion during normal boiler operation, such that the tilting forces used to tilt the inner nozzle tip portion are applied to the outer nozzle tip portion. This is due to the enlarged contact surface area that the inner nozzle tip portion experiences, which reduces point contact loading. As a result, the tilting forces that are applied to the inner nozzle tip portion will be minimized. Minimizing tilting forces in this manner inhibits point contact loading and stress to the inner nozzle tip portion.

The previously mentioned benefit of tolerating high temperatures through the use of ceramics is further enhanced by the feature of the air shroud with the outer nozzle tip portion. That is, the plurality of air passages provided by the air shroud enables the pulverized solid fuel nozzle tip assembly of the various embodiments to offer further cooling to the inner nozzle tip portion by delivering the secondary air towards the outer surfaces of the inner nozzle tip portion. Not only do the plurality of air passages help the pulverized solid fuel nozzle tip assembly of the various embodiments operate in extremely high temperatures, but these air passages in the outer nozzle tip portion make it possible to manufacture the nozzle tip assembly with lower overall manufacturing costs since the monolithic, ceramic inner nozzle tip portion can be fabricated without these air passages.

In one embodiment, an optional inner nozzle tip protection part can extend from the top plate and the bottom plate of the seal frame structure of the outer nozzle tip portion over the top surface and the bottom surface of the inner nozzle tip portion, respectively. In this manner, the optional inner nozzle tip protection part can serve to protect the monolithic, ceramic inner nozzle tip portion from items that can include, but are not limited to, slag falling from the furnace walls. In addition, the optional inner nozzle tip protection part can receive the secondary stream of air from the first and second plurality of air passages of the air shroud.

The pulverized solid fuel nozzle tip assembly of the various embodiments also eliminates stress cracking to the inner nozzle tip portion that can arise due to thermal growth of the components of the nozzle tip assembly. In particular, the lateral sidewalls of the frame of the outer nozzle tip portion contain no extraneous elements that can expand and come into contact with the inner nozzle tip portion, and thus cause cracking of the inner nozzle tip portion. With all extraneous elements removed from the lateral sidewalls of the frame of the outer nozzle tip portion, the possibility of the stainless steel outer nozzle tip portion expanding into the ceramic inner nozzle tip portion and cracking the inner nozzle tip portion due to thermal expansion differentials between the ceramic and stainless steel components of the inner nozzle tip portion and the outer nozzle tip portion, respectively, is eliminated/reduced.

In addition, the removal of extraneous elements from the lateral sidewalls of the frame of the outer nozzle tip portion also has the added benefit of allowing one to measure the clearances between the outer nozzle tip portion and the inner nozzle tip portion during fabrication and assembly of the components. Nozzle tip assemblies with extraneous elements on the lateral sidewalls of the outer nozzle tip portion not only can cause cracking of the inner nozzle tip portion during thermal growth of the components.

As a result of these benefits, which are apparent in comparison to a conventional nozzle tip assembly, the solution offered by the various embodiments is a cost effective design which can be implemented in accordance with a number of different options. For example, the outer nozzle tip portion of the nozzle tip assembly can be manufactured using a 3D printing process with a suitable material that meets the aforementioned material properties of the outer nozzle tip portion. In addition, the internal design of the ceramics for the inner nozzle tip portion of the nozzle tip assembly can be designed according to the specifications of the steam generator (e.g., the pulverized solid fuel-fired boiler). Furthermore, the outer nozzle tip portion of the nozzle tip assembly can have the option to be cast as opposed to being fabricated from a plate. These design options for the nozzle tip assembly make it suitable for boiler side removal which is beneficial for installation, as well as maintenance and service operations.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. For example, parts, components, steps and aspects from different embodiments may be combined or suitable for use in other embodiments even though not described in the disclosure or depicted in the figures. Therefore, since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below. For example, references to "one embodiment" of the present invention are not intended to be interpreted as excluding the existence of additional embodiments that also incorporate the recited features.

In the appended claims, the terms "including" and "in which" are used as the plain-English equivalents of the respective terms "comprising" and "wherein." Moreover, in the following claims, terms such as "first," "second,"

"third," "upper," "lower," "bottom," "top," etc. are used merely as labels, and are not intended to impose numerical or positional requirements on their objects. The terms "substantially," "generally," and "about" indicate conditions within reasonably achievable manufacturing and assembly tolerances, relative to ideal desired conditions suitable for achieving the functional purpose of a component or assembly. Further, the limitations of the following claims are not written in means-plus-function format and are not intended to be interpreted as such, unless and until such claim limitations expressly use the phrase "means for" followed by a statement of function void of further structure.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings, such terms are intended to be inclusive in a manner similar to the term "comprising" as "comprising" is interpreted when employed as a transitional word in a claim. That is, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

A pulverized solid fuel nozzle tip assembly adapted for cooperative operation with a pulverized solid fuel pipe nozzle to issue a stream of pulverized solid fuel and air to a pulverized solid fuel-fired boiler, comprising: an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes: a pair of opposing lateral sidewalls, each of the opposing lateral sidewalls including a front surface having a contoured profile defining a plurality of spaced recess portions with nose portions formed therebetween; a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom plate extending horizontally between the pair of opposing lateral sidewalls; and an inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes: a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion.

The pulverized solid fuel nozzle tip assembly of the preceding clause, wherein each of the plurality of inset lug plates comprises a shape with a profile that matches with one of the nose portions on the front surfaces of each of the opposing lateral sidewalls of the outer nozzle tip portion.

The pulverized solid fuel nozzle tip assembly of any of the preceding clauses, wherein each of the plurality of inset lug plates and the nose portions on the front surfaces of each of the opposing lateral sidewalls of the outer nozzle tip portion comprises a tilting link arm mounting bore extending therethrough.

The pulverized solid fuel nozzle tip assembly of any of the preceding clauses, wherein one of the plurality of inset lug plates is operative to have a tilting link arm coupled thereto.

The pulverized solid fuel nozzle tip assembly of any of the preceding clauses, further comprising a tilting link arm pivot pin to secure the tilting link arm to the one of the plurality of inset lug plates and the corresponding nose portion of the opposing lateral sidewalls of the outer nozzle tip portion that is flush therewith, the tilting link arm pivot pin extending through the tilting link arm mounting bore in the one of the plurality of inset lug plates and the corresponding nose portion of the opposing lateral sidewalls of the outer nozzle tip portion that is flush therewith, placing the tilting link arm pivot pin in double shear.

The pulverized solid fuel nozzle tip assembly of any of the preceding clauses, wherein the top plate and the bottom plate of the seal frame structure are each transversely oriented to adjacent recess portions on the front surfaces of the opposing lateral sidewalls of the outer nozzle tip portion.

The pulverized solid fuel nozzle tip assembly of any of the preceding clauses, wherein the outer nozzle tip portion further comprises an air shroud adapted to receive a secondary stream of air, the air shroud having a first plurality of air passages located on the top plate of the seal frame structure, secured between the pair of opposing lateral sidewalls, and a second plurality of air passages located under the bottom plate of the seal frame structure, secured between the pair of opposing lateral sidewalls, both the first plurality of air passages and the second plurality of air passages are adapted to produce different flow pathways for the secondary stream of air.

The pulverized solid fuel nozzle tip assembly of any of the preceding clauses, wherein the first and second plurality of air passages of the air shroud are operative to direct the secondary stream of air over an outer surface of the inner nozzle tip portion.

The pulverized solid fuel nozzle tip assembly of any of the preceding clauses, further comprising an inner nozzle tip protection part that extends from the top plate and the bottom plate of the seal frame structure over the inner nozzle tip portion, wherein the inner nozzle tip protection part is operative to provide protection for the inner nozzle tip portion and to receive the secondary stream of air from the first plurality of air passages and the second plurality of air passages of the air shroud.

The pulverized solid fuel nozzle tip assembly of any of the preceding clauses, further comprising a pair of opposing pivot pins operative to secure the inner nozzle tip portion to the lateral sidewalls of the outer nozzle tip portion, the pivot pins extending through one of the nose portions on the back surfaces of the opposing sidewalls of the inner nozzle tip portion and one of the recess portions of the opposing lateral sidewalls of the outer nozzle tip portion.

The pulverized solid fuel nozzle tip assembly of any of the preceding clauses, wherein each of the pair of opposing pivot pins is positioned in a central location relative to the sidewalls of the inner nozzle tip portion and the outer nozzle tip portion on a lateral centerline to facilitate titling of the inner nozzle tip portion over a predetermined a tilt range.

The pulverized solid fuel nozzle tip assembly of any of the preceding clauses, further comprising: a pair of opposing pivot pin mounting bores, each extending through one of the corresponding lateral sidewalls of the outer nozzle tip portion and one of the sidewalls of the inner nozzle tip portion; and a pair of bushings, each placed in one of the opposing pivot pin mounting bores to rotatably support one of the pivot pins.

The pulverized solid fuel nozzle tip assembly of any of the preceding clauses, wherein the seating of the nose portions on the back surfaces of the opposing sidewalls of the inner nozzle tip portion in the recess portions on the front surfaces of the opposing lateral sidewalls of the outer nozzle tip portion and the seating of the nose portions and respective inset lug plates on the front surfaces of the opposing lateral sidewalls of the outer nozzle tip portion in the recess portions on the back surfaces of the opposing sidewalls of the inner nozzle tip portion provide an outer nozzle tip portion to inner nozzle tip portion contact surface.

The pulverized solid fuel nozzle tip assembly of any of the preceding clauses, wherein the outer nozzle tip portion to inner nozzle tip portion contact surface directs tilting forces used to tilt the inner nozzle tip portion to be applied to the outer nozzle tip portion, minimizing the tilting forces applied to the inner nozzle tip portion.

A pulverized coal nozzle tip assembly adapted for cooperative operation with a pulverized coal pipe nozzle to issue a stream of pulverized coal and air to a coal-fired boiler, comprising: an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes: a pair of opposing lateral sidewalls, each of the opposing lateral sidewalls including a front surface having a contoured profile defining a plurality of spaced recess portions with nose portions formed therebetween; a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom extending horizontally between the pair of opposing lateral sidewalls; a monolithic, ceramic, inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes: a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion; and an air shroud adapted to receive a secondary stream of air, the air shroud having a first plurality of air passages located on the top plate of the seal frame structure, secured between the pair of opposing lateral sidewalls, and a second plurality of air passages located under the bottom plate of the seal frame structure, secured between the pair of opposing lateral sidewalls, both the first plurality of air passages and the second plurality of air passages are adapted to produce different flow pathways for the secondary stream of air.

The pulverized coal nozzle tip assembly of the preceding clause, wherein each of the plurality of inset lug plates comprises a shape with a profile that matches with one of the nose portions on the front surfaces of each of the opposing lateral sidewalls of the outer nozzle tip portion.

The pulverized coal nozzle tip assembly of any of the preceding clauses, wherein each of the plurality of inset lug plates and the nose portions on the front surfaces of each of the opposing lateral sidewalls of the outer nozzle tip portion comprises a tilting link arm mounting bore extending therethrough.

The pulverized coal nozzle tip assembly of any of the preceding clauses, wherein one of the plurality of inset lug plates is operative to have a tilting link arm coupled thereto.

The pulverized coal nozzle tip assembly of any of the preceding clauses, further comprising a tilting link arm pivot pin to secure the tilting link arm to the one of the plurality of inset lug plates and the corresponding nose portion of the opposing lateral sidewalls of the outer nozzle tip portion that is flush therewith, the tilting link arm pivot pin extending through the tilting link arm mounting bore in the one of the plurality of inset lug plates and the corresponding nose portion of the opposing lateral sidewalls of the outer nozzle tip portion that is flush therewith, placing the tilting link arm pivot pin in double shear.

The pulverized coal nozzle tip assembly of any of the preceding clauses, further comprising an inner nozzle tip protection part that extends from the top plate and the bottom plate of the seal frame structure over the inner nozzle tip portion, wherein the inner nozzle tip protection part is operative to provide protection for the inner nozzle tip portion and to receive the secondary stream of air from the first plurality of air passages and the second plurality of air passages of the air shroud.

What is claimed is:

1. A pulverized solid fuel nozzle tip assembly adapted for cooperative operation with a pulverized solid fuel pipe nozzle to issue a stream of pulverized solid fuel and air to a pulverized solid fuel-fired boiler, comprising:

an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes:

a pair of opposing lateral sidewalls, each of the opposing lateral sidewalls including a front surface having a contoured profile defining a plurality of spaced recess portions with nose portions formed therebetween;

a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom plate extending horizontally between the pair of opposing lateral sidewalls; and an inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes:

a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion.

2. The pulverized solid fuel nozzle tip assembly according to claim 1, wherein each of the plurality of inset lug plates and the nose portions on the front surfaces of each of the opposing lateral sidewalls of the outer nozzle tip portion comprises a tilting link arm mounting bore extending therethrough.

3. The pulverized solid fuel nozzle tip assembly according to claim 2, wherein one of the plurality of inset lug plates is operative to have a tilting link arm coupled thereto.

4. The pulverized solid fuel nozzle tip assembly according to claim 3, further comprising a tilting link arm pivot pin to secure the tilting link arm to the one of the plurality of inset lug plates and the corresponding nose portion of the opposing lateral sidewalls of the outer nozzle tip portion that is flush therewith, the tilting link arm pivot pin extending through the tilting link arm mounting bore in the one of the plurality of inset lug plates and the corresponding nose portion of the opposing lateral sidewalls of the outer nozzle tip portion that is flush therewith, placing the tilting link arm pivot pin in double shear.

5. The pulverized solid fuel nozzle tip assembly according to claim 1, wherein the top plate and the bottom plate of the seal frame structure are each transversely oriented to adjacent recess portions on the front surfaces of the opposing lateral sidewalls of the outer nozzle tip portion.

6. The pulverized solid fuel nozzle tip assembly according to claim 1, further comprising a pair of opposing pivot pins operative to secure the inner nozzle tip portion to the lateral sidewalls of the outer nozzle tip portion, the pivot pins extending through one of the nose portions on the back surfaces of the opposing sidewalls of the inner nozzle tip portion and one of the recess portions of the opposing lateral sidewalls of the outer nozzle tip portion.

7. The pulverized solid fuel nozzle tip assembly according to claim 6, further comprising:

a pair of opposing pivot pin mounting bores, each extending through one of the corresponding lateral sidewalls of the outer nozzle tip portion and one of the sidewalls of the inner nozzle tip portion; and a pair of bushings, each placed in one of the opposing pivot pin mounting bores to rotatably support one of the pivot pins.

8. The pulverized solid fuel nozzle tip assembly according to claim 1, wherein the seating of the nose portions on the back surfaces of the opposing sidewalls of the inner nozzle tip portion in the recess portions on the front surfaces of the opposing lateral sidewalls of the outer nozzle tip portion and the seating of the nose portions and respective inset lug plates on the front surfaces of the opposing lateral sidewalls of the outer nozzle tip portion in the recess portions on the back surfaces of the opposing sidewalls of the inner nozzle tip portion provide an outer nozzle tip portion to inner nozzle tip portion contact surface.

9. The pulverized solid fuel nozzle tip assembly according to claim 8, wherein the outer nozzle tip portion to inner nozzle tip portion contact surface directs tilting forces used to tilt the inner nozzle tip portion to be applied to the outer nozzle tip portion, minimizing the tilting forces applied to the inner nozzle tip portion.

10. A pulverized coal nozzle tip assembly adapted for cooperative operation with a pulverized coal pipe nozzle to issue a stream of pulverized coal and air to a coal-fired boiler, comprising:

an outer nozzle tip portion adapted for mounting in supported relation with the pulverized solid fuel pipe nozzle, the outer nozzle tip portion having an inlet end, an outlet end, and a flow channel extending therethrough from the inlet end to the outlet end, wherein the outer nozzle tip portion includes:

a pair of opposing lateral sidewalls, each of the opposing lateral sidewalls including a front surface having a contoured profile defining a plurality of spaced recess portions with nose portions formed therebetween;

a plurality of inset lug plates coupled to the pair of opposing lateral sidewalls, each inset lug plate disposed flush with one of the nose portions in each of the opposing lateral sidewalls; and a seal frame structure located interior to the pair of opposing lateral sidewalls, the seal frame structure having a top plate and a bottom plate spaced apart from the top plate, both the top plate and the bottom extending horizontally between the pair of opposing lateral sidewalls;

a monolithic, ceramic, inner nozzle tip portion tiltably secured to the outer nozzle tip portion for longitudinal movement relative to the outer nozzle tip portion, the inner nozzle tip portion having an inlet end, an outlet end, and a flow passageway formed therebetween to receive the stream of pulverized solid fuel and air, wherein the inner nozzle tip portion includes:

a pair of opposing sidewalls, each of the opposing sidewalls having a back surface with a contoured profile defining a plurality of spaced recess portions with nose portions formed therebetween, the nose portions on the back surfaces of the opposing sidewalls of the inner nozzle tip portion seated correspondingly in the recess portions on the front surfaces of the opposing lateral sidewalls of the outer nozzle tip portion, and the nose portions and the respective inset lug plates on the front surfaces of the opposing lateral sidewalls of the outer nozzle tip portion seated correspondingly in the recess portions on the back surfaces of the sidewalls of the inner nozzle tip portion; and an air shroud adapted to receive a secondary stream of air, the air shroud having a first plurality of air passages located on the top plate of the seal frame structure, secured between the pair of opposing lateral sidewalls, and a second plurality of air passages located under the bottom plate of the seal frame structure, secured between the pair of opposing lateral sidewalls, both the first plurality of air passages and the second plurality of air passages are adapted to produce different flow pathways for the secondary stream of air.

11. The pulverized coal fuel nozzle tip assembly according to claim 10, wherein each of the plurality of inset lug plates comprises a shape with a profile that matches with one of the nose portions on the front surfaces of each of the opposing lateral sidewalls of the outer nozzle tip portion.

12. The pulverized coal fuel nozzle tip assembly according to claim 10, wherein each of the plurality of inset lug plates and the nose portions on the front surfaces of each of the opposing lateral sidewalls of the outer nozzle tip portion comprises a tilting link arm mounting bore extending therethrough.

13. The pulverized coal fuel nozzle tip assembly according to claim 12, wherein one of the plurality of inset lug plates is operative to have a tilting link arm coupled thereto.

14. The pulverized coal fuel nozzle tip assembly according to claim 13, further comprising a tilting link arm pivot pin to secure the tilting link arm to the one of the plurality of inset lug plates and the corresponding nose portion of the opposing lateral sidewalls of the outer nozzle tip portion that is flush therewith, the tilting link arm pivot pin extending through the tilting link arm mounting bore in the one of the plurality of inset lug plates and the corresponding nose portion of the opposing lateral sidewalls of the outer nozzle tip portion that is flush therewith, placing the tilting link arm pivot pin in double shear.

15. The pulverized coal fuel nozzle tip assembly according to claim 10, further comprising an inner nozzle tip protection part that extends from the top plate and the bottom plate of the seal frame structure over the inner nozzle tip portion, wherein the inner nozzle tip protection part is operative to provide protection for the inner nozzle tip portion and to receive the secondary stream of air from the first plurality of air passages and the second plurality of air passages of the air shroud.

* * * * *